US007976127B2

(12) United States Patent
Hano et al.

(10) Patent No.: US 7,976,127 B2
(45) Date of Patent: Jul. 12, 2011

(54) ELECTROSTATIC ACTUATOR, DROPLET DISCHARGE HEAD, METHODS FOR MANUFACTURING THE SAME AND DROPLET DISCHARGE APPARATUS

(75) Inventors: Yoshifumi Hano, Suwa (JP); Masahiro Fujii, Shiojiri (JP)

(73) Assignee: Seiko Epson Corporation (JP)

( * ) Notice: Subject to any disclaimer, the term of this patent is extended or adjusted under 35 U.S.C. 154(b) by 830 days.

(21) Appl. No.: 11/949,115

(22) Filed: Dec. 3, 2007

(65) Prior Publication Data

US 2008/0129785 A1 Jun. 5, 2008

(30) Foreign Application Priority Data

Dec. 4, 2006 (JP) ..... 2006-327449
Dec. 4, 2006 (JP) ..... 2006-327505
Oct. 16, 2007 (JP) ..... 2007-268718

(51) Int. Cl.
*B41J 2/04* (2006.01)

(52) U.S. Cl. ..... 347/54; 347/68; 347/70; 347/71

(58) Field of Classification Search ..... 347/20, 347/54, 68, 70, 71, 55, 64
See application file for complete search history.

(56) References Cited

U.S. PATENT DOCUMENTS 6,568,794 B2 * 5/2003 Yamanaka et al. ..... 347/54

FOREIGN PATENT DOCUMENTS

| | | |
|---|---|---|
| JP | 08-118626 | 5/1996 |
| JP | 10-157121 | 6/1998 |
| JP | 10-157124 | 6/1998 |
| JP | 10-296973 | 11/1998 |
| JP | 11-10879 | 1/1999 |
| JP | 2002-19129 | 1/2002 |
| JP | 2002-46282 | 2/2002 |
| JP | 2003-80708 | 3/2003 |
| JP | 2006-88676 | 4/2006 |
| JP | 2006-198820 | 8/2006 |
| JP | 2006-263933 | 10/2006 |
| JP | 2006-271183 | 10/2006 |
| JP | 2006-278579 | 10/2006 |
| JP | 2006-304379 | 11/2006 |

* cited by examiner

*Primary Examiner* — Juanita D Stephens
(74) *Attorney, Agent, or Firm* — Harness, Dickey & Pierce, P.L.C.

(57) ABSTRACT

An electrostatic actuator includes a fixed electrode formed on a substrate, a movable electrode provided so as to oppose the fixed electrode with a predetermined gap therebetween, a driving unit generating electrostatic force between the fixed electrode and the movable electrode and moving the movable electrode, insulating films provided on opposing faces of the fixed electrode and the movable electrode, at least one of the insulating films having a layered structure of silicon oxide and a dielectric material whose relative permittivity is higher than the relative permittivity of the silicon oxide, and a surface protection film provided one or both of the insulating films and made of a ceramics-based hard film or a carbon-based hard film.

10 Claims, 26 Drawing Sheets

ELECTROSTATIC ACTUATOR, DROPLET DISCHARGE HEAD, METHODS FOR MANUFACTURING THE SAME AND DROPLET DISCHARGE APPARATUS

BACKGROUND OF THE INVENTION

1. Technical Field

The present invention relates to an electrostatic actuator which can be used for an electrostatic driving type ink-jet head and the like, a droplet discharge head, manufacturing methods thereof and a droplet discharge apparatus.

2. Related Art

An electrostatic driving type ink-jet head mounted on a ink-jet recording apparatus can be named as an example of a droplet discharge head that discharges droplets. A typical electrostatic type ink-jet head has an electrostatic actuator part having an individual electrode (a fixed electrode) that is formed on a glass substrate and a silicon vibration plate (a movable electrode) that opposes to the individual electrode with a predetermined gap therebetween. The typical electrostatic type ink-jet head also includes a nozzle substrate in which a plurality of nozzle openings for discharging ink droplets is provided, a discharge chamber that is jointed to the nozzle substrate and communicates with the nozzle opening of the nozzle substrate, and a cavity substrate in which an ink flow passage such as a reservoir is provided. When an electrostatic force is generated in the above-mentioned actuator part, the discharge chamber is pressurized, and ink droplets are discharged from the selected nozzle opening.

In the typical electrostatic actuator, an insulating film is formed on faces that oppose the vibration plate and the individual electrode in order to prevent dielectric breakdown or short-circuit of an insulating film which is formed in the actuator and to secure stability and endurance in the actuator driving. The insulating film is usually made of a thermally-oxidized silicon film. This is because the production of the thermally-oxidized silicon film is relatively easy and it has a fine insulation property. JP-A-2002-19129 is a first example of related art. The first example proposes the electrostatic actuator in which the opposing face of the vibration plate has an insulating film made of a silicon oxide film (hereinafter referred as a "TEOS-$SiO_2$ film") which is formed by a plasma chemical vapor deposition (CVD) method using tetra-ethoxy-silane (TEOS) as the gaseous basic material. JP-A-8-118626 and JP-A-2003-80708 are a second and a third examples of related art. Where the insulating film is formed only on a one side of the vibration plate, residual electric charges occur in the insulating film of a dielectric body. These residual electric charges deteriorate the stability and the endurance in the actuator driving. To avoid this, the second example proposes the electrostatic actuator in which both faces opposing the vibration plate and the individual electrode respectively have the insulating film. JP-A-2002-46282 is a fourth example of related art. To reduce the residual electric charges, the fourth example proposes the electrostatic actuator in which only the face of the individual electrode side has a double layered electrode protection film consisting of a high volume resistance film and a low volume resistance film. JP-A-2006-271183 is a fifth example of related art. The fifth example proposes the electrostatic actuator in which the insulating film of the actuator is made of a so-called High-k material (a high dielectric constant gate insulating film) whose dielectric constant is higher than that of the silicon oxide thereby the actuator can generate a higher pressure.

Where the thermally oxidized silicon film is used for the insulating film of the electrode in the electrostatic actuator, there is a disadvantage that the application of the thermally oxidized silicon film is limited to a silicon substrate. In the case where the TEOS-$SiO_2$ film is used as the insulating film as described in the first example, the film is contaminated with many carbonaceous impurities because of the nature of the film formation method, CVD. From a result of a driving endurance test, it was found out that there is a problem in the stability of the film such that the TEOS-$SiO_2$ film is abraded away when the vibration plate and the individual electrode repeatedly contact each other.

The second example discloses the electrostatic actuator in which a thermally oxidized film is formed on a face which is situated closer to the vibration plate and a silicon oxide film (hereinafter referred as "a sputter film") is formed on a face which is situated closer to the individual electrode by sputtering. However the sputter film has a weak dielectric strength so that either the film thickness has to be increased or another better insulation film such as a thermally oxide film has to be further formed in order to prevent the dielectric breakdown of the electrostatic actuator.

According to the third example, both electrodes of the vibration plate and the individual electrode are made from silicon substrates, the insulating film made of a thermally oxidized film is provided not only on the side of the vibration plate but also on the side of the individual electrode, and an insulating film is not formed on a joint face of the silicon substrate. However the silicon substrate is more expensive than the glass substrate, causing a cost problem in the production of the actuator.

The fourth example discloses the electrostatic actuator in which only the face of the individual electrode side has the double layered electrode protection film consisting of a high volume resistance film and a low volume resistance film, and the vibration plate is formed of metal such as molybdenum, tungsten and nickel. However the structure of the electrostatic actuator becomes complicated with such insulating structure and the manufacturing process also becomes complicated. This also causes a cost problem.

The fifth example aims to increase the pressure generated by the actuator by adopting a material whose dielectric constant is higher than that of the silicon oxide for the insulating film of the actuator, which can be explained with reference to the hereunder presented Formula 2. Voltage is needed to be applied between the electrodes in order to drive the actuator. If the dielectric strength of the insulating film provided on the electrode is low, the voltage range applicable to the actuator has to be set lower. Even where the so-called High-k material is used for the insulating film, if the dielectric strength of the High-k material is lower than that of the silicon oxide, it is difficult to increase the pressure which is generated by the actuator (because the applied voltage V has to be set smaller than the value derived by the Formula 2).

Moreover, none of the above-mentioned examples mentions about the combination of the High-k material and the surface protection film concerning the insulating film of the actuator. Particularly, the surface protection film is a member which securely protects the insulating film and the surface protection film is essential for the electrostatic actuator to obtain a long-term driving endurance.

Meanwhile, as for the static driving type ink-jet head having the electrostatic actuators, requests of a higher density and a high speed driving are raised recently for the ink-jet head as a request of higher resolution images is increasing. At the same time, downsizing of the actuator is also requested. To meet such requests, it is important to develop the insulating structure with which the pressure capacity generated by the electrostatic actuator can be increased and the driving stability and the driving endurance can be further improved with a minimum cost.

SUMMARY

An advantage of the present invention is to provide an electrostatic actuator with which the above-mentioned problems can be solved and to provide a droplet discharge head which can meet the requests of the high density and the high speed driving that are essential to realize a high resolution image. Another advantage of the invention is to provide manufacturing methods thereof and a droplet discharge apparatus thereof.

An electrostatic actuator according to a first aspect of the invention includes a fixed electrode formed on a substrate, a movable electrode provided so as to oppose the fixed electrode with a predetermined gap therebetween, a driving unit generating electrostatic force between the fixed electrode and the movable electrode and moving the movable electrode, insulating films provided on opposing faces of the fixed electrode and the movable electrode, at least one of the insulating films having a layered structure of silicon oxide and a dielectric material whose relative permittivity is higher than the relative permittivity of the silicon oxide, and a surface protection film provided one or both of the insulating films and made of a ceramics-based hard film or a carbon-based hard film.

According to the first aspect of the invention, the insulating film is respectively formed on the fixed electrode and the movable electrode, and one of the insulating films has the layered structure of the silicon oxide and the High-k material which is the dielectric material whose relative permittivity is higher than that of the silicon oxide. The surface protection film made of the ceramics based hard film or the carbon based hard film is further formed on at least one of the insulating films. Since the surface protection film is a hard film, the insulating film is protected by the surface protection film and its insulation property is maintained even when the movable electrode repeatedly contacts with the fixed electrode. At the same time it is possible to reduce the amount of the electric charge caused by the contact electrification. Moreover friction, detachment and the like will not occur because the surface protection film is made of a hard film. Consequently, the stability and the endurance in the driving of the electrostatic actuator are improved. Furthermore, it is possible to increase the pressure generated in the electrostatic actuator because one of the insulating films has the layered structure of the silicon oxide and the High-k material. In the case where the pressure generated in the actuator is an identical pressure, the electrostatic actuator with a fine dielectric strength voltage can be formed by increasing the thickness of the insulating film. In this way, it is possible to minimize the electrostatic actuator and to increase the alignment density of the actuators.

An electrostatic actuator according to a second aspect of the invention includes a fixed electrode formed on a substrate, a movable electrode provided so as to oppose the fixed electrode with a predetermined gap therebetween, a driving unit generating electrostatic force between the fixed electrode and the movable electrode and moving the movable electrode, insulating films provided on opposing faces of the fixed electrode and the movable electrode, at least one of the insulating films having a layered structure of dielectric materials whose relative permittivity is higher than a relative permittivity of silicon oxide, and a surface protection film provided one or both of the insulating films and made of a ceramics-based hard film or a carbon-based hard film.

According to the second aspect of the invention, the insulating film is respectively formed on the fixed electrode and the movable electrode, and one of the insulating films has the layered structure of the High-k materials which are the dielectric materials whose relative permittivity is higher than that of the silicon oxide. The surface protection film made of the ceramics based hard film or the carbon based hard film is further formed on one or both of the insulating films. Since the surface protection film is a hard film, the insulating film is protected by the surface protection film and friction, detachment and the like will not occur even when the movable electrode repeatedly contacts with the fixed electrode. At the same time it is possible to reduce the amount of the electric charge caused by the contact electrification. Therefore the stability and the endurance in the driving of the electrostatic actuator are improved. Furthermore, it is possible to increase the pressure generated in the electrostatic actuator because one of the insulating films has the layered structure of the High-k materials. In the case where the pressure generated in the actuator is an identical pressure, the electrostatic actuator with a fine dielectric strength voltage can be formed by increasing the thickness of the insulating film. In this way, it is possible to minimize the electrostatic actuator and to increase the alignment density of the actuators.

It is preferable that the surface protection film be made of a carbon-based material such as diamond and diamond-like carbon. The diamond-like carbon is most preferable for the surface protection film because it has a fine adhesion with the insulating film, a highly smooth and low friction surface.

It is also preferable that the dielectric material whose relative permittivity is higher than the relative permittivity of the silicon oxide be selected at least from the group including aluminum oxide ($Al_2O_3$), hafnium oxide ($HfO_2$), hafnium silicate nitride (HfSiN) and hafnium silicate oxynitride (HfSiON). These materials are the dielectric materials whose relative permittivity is higher than that of the silicon oxide. In addition, these materials can be formed at a low temperature, and the films of the materials are highly homogeneous and have a fine adaptability to a manufacturing process.

It is preferable that the fixed electrode be formed on a glass substrate, the movable electrode be formed on a silicon substrate, and the glass substrate and the silicon substrate be jointed together through a silicon oxide film that is formed on at least one of joint faces of the substrates. It is preferable that the silicon oxide film is formed on the joint face between the glass substrate and the silicon substrate because the silicon oxide is an appropriate material for anodic bonding.

It is preferable that the fixed electrode be formed on a glass substrate, the movable electrode be formed on a silicon substrate, and the glass substrate and the silicon substrate are jointed together on the joint part through a silicon oxide film or a dielectric material whose relative permittivity is higher than that of the silicon oxide and which has a fine joint strength. More specifically, the silicon oxide is an appropriate material for anodic bonding so that the silicon oxide film is preferably formed on the joint part between the glass substrate and the silicon substrate. Where the insulating film provided on the joint part is the dielectric material whose relative permittivity is higher than that of the silicon oxide, it is preferable that the insulating film be made of the dielectric material having a fine joint strength as much as possible, more specifically, an alumina insulating film is preferably formed in the joint part.

For the same reason, the silicon oxide film of the insulating film that has the layered structure of the silicon oxide and the dielectric material whose relative permittivity is higher than the relative permittivity of the silicon oxide is preferably provided on the joint face between the glass substrate and the silicon substrate.

It is also preferable that a thermally oxidized silicon film be provided on the movable electrode side as a second insulating film. Where the insulating film having the layered structure of the silicon oxide and the High-k material is provided on the fixed electrode side, the thermally oxidized silicon film is preferably provided on the movable electrode side as the second insulating film because the thermally oxidized silicon film has a high dielectric strength voltage and a high joint strength.

According to a third aspect of the invention, a method for manufacturing an electrostatic actuator that includes a fixed electrode formed on a substrate, a movable electrode provided so as to oppose the fixed electrode with a predetermined gap therebetween and a driving unit generating electrostatic force between the fixed electrode and the movable electrode and moving the movable electrode, includes:

forming a silicon oxide film as a first insulating film on a glass substrate on which the fixed electrode is formed;

forming an insulating film that has a layered structure of silicon oxide and a dielectric material whose relative permittivity is higher than the relative permittivity of the silicon oxide, the insulating film being formed as a second insulating film on an overall joint face of a silicon substrate on which the movable electrode is formed, and the joint face being a face where the glass substrate is jointed;

forming a surface protection film on one or both of the first insulating film and the second insulating film, the surface protection film being made of a ceramics-based hard film or a carbon-based hard film;

bonding the glass substrate and the silicon substrate anodically;

forming the movable electrode by etching a face opposite to the joint face of the silicon substrate;

removing moisture in the gap between the fixed electrode and the movable electrode; and sealing the gap air-tightly.

According to the third aspect, the insulating film having the layered structure of the silicon oxide and the dielectric material whose relative permittivity is higher than the relative permittivity of the silicon oxide is formed on the movable electrode side as the second insulating film. Thereby it is possible to increase the pressure generated in the electrostatic actuator. Moreover the required joint strength and dielectric strength voltage can be secured because the first and second insulating films include the silicon oxide film. Furthermore the surface protection film made of a ceramics-based hard film or a carbon-based hard film is formed on one or both of the first insulating film and the second insulating film. Therefore it is possible to manufacture the electrostatic actuator having a fine driving stability and driving endurance.

According to a fourth aspect of the invention, a method for manufacturing an electrostatic actuator that includes a fixed electrode formed on a substrate, a movable electrode provided so as to oppose the fixed electrode with a predetermined gap therebetween and a driving unit generating electrostatic force between the fixed electrode and the movable electrode and moving the movable electrode includes:

forming an insulating film that has a layered structure of silicon oxide and a dielectric material whose relative permittivity is higher than the relative permittivity of the silicon oxide, the insulating film being formed as a first insulating film on a glass substrate on which the fixed electrode is formed;

forming a silicon oxide film as a second insulating film on an overall joint face of a silicon substrate on which the movable electrode is formed, and the joint face being a face where the glass substrate is jointed;

forming a surface protection film on one or both of the first insulating film and the second insulating film, the surface protection film being made of a ceramics-based hard film or a carbon-based hard film;

bonding the glass substrate and the silicon substrate anodically;

forming the movable electrode by etching a face opposite to the joint face of the silicon substrate;

removing moisture in the gap between the fixed electrode and the movable electrode; and sealing the gap air-tightly.

According to the fourth aspect, the insulating film having the layered structure of the silicon oxide and the dielectric material whose relative permittivity is higher than the relative permittivity of the silicon oxide is formed on the fixed electrode side on the contrary to the third aspect as the first insulating film. Thereby it is possible to increase the pressure generated in the electrostatic actuator. Moreover the required joint strength and dielectric strength voltage can be secured because the first and second insulating films include the silicon oxide film. Furthermore the surface protection film made of a ceramics-based hard film or a carbon-based hard film is formed on at least one of the first insulating film and the second insulating film. Therefore it is possible to manufacture the electrostatic actuator having a fine driving stability and driving endurance.

According to a fifth aspect of the invention, a method for manufacturing an electrostatic actuator that includes a fixed electrode formed on a substrate, a movable electrode provided so as to oppose the fixed electrode with a predetermined gap therebetween and a driving unit generating electrostatic force between the fixed electrode and the movable electrode and moving the movable electrode, includes:

forming a silicon oxide film as a first insulating film on a glass substrate on which the fixed electrode is formed;

forming an insulating film that has a layered structure of dielectric materials whose relative permittivity is higher than a relative permittivity of silicon oxide, the insulating film being formed as a second insulating film on an overall joint face of a silicon substrate on which the movable electrode is formed, and the joint face being a face where the glass substrate is jointed;

forming a surface protection film on one or both of the first insulating film and the second insulating film, the surface protection film being made of a ceramics-based hard film or a carbon-based hard film;

bonding the glass substrate and the silicon substrate anodically;

forming the movable electrode by etching a face opposite to the joint face of the silicon substrate;

removing moisture in the gap between the fixed electrode and the movable electrode; and sealing the gap air-tightly.

According to the fifth aspect, the insulating film having the layered structure of dielectric materials whose relative permittivity is higher than a relative permittivity of silicon oxide is formed on the movable electrode side as the second insulating film. Thereby it is possible to increase the pressure generated in the electrostatic actuator as well as to secure the required joint strength and dielectric strength voltage. Furthermore the surface protection film made of a ceramics-based hard film or a carbon-based hard film is formed on at least one of the first insulating film and the second insulating film. Therefore it is possible to manufacture the electrostatic actuator having a fine driving stability and driving endurance.

According to a sixth aspect of the invention, a method for manufacturing an electrostatic actuator that includes a fixed electrode formed on a substrate, a movable electrode provided so as to oppose the fixed electrode with a predetermined gap therebetween and a driving unit generating electrostatic force between the fixed electrode and the movable electrode and moving the movable electrode, includes:

forming an insulating film that has a layered structure of dielectric materials whose relative permittivity is higher than a relative permittivity of silicon oxide, the insulating film being formed as a first insulating film on a glass substrate on which the fixed electrode is formed;

forming a thermally oxidized silicon film as a second insulating film on an overall joint face of a silicon substrate on which the movable electrode is formed, and the joint face being a face where the glass substrate is jointed;

forming a surface protection film on one or both of the first insulating film and the second insulating film, the surface protection film being made of a ceramics-based hard film or a carbon-based hard film;

bonding the glass substrate and the silicon substrate anodically;

forming the movable electrode by etching a face opposite to the joint face of the silicon substrate;

removing moisture in the gap between the fixed electrode and the movable electrode; and sealing the gap air-tightly.

According to the sixth aspect, the insulating film having the layered structure of dielectric materials whose relative permittivity is higher than a relative permittivity of silicon oxide is formed on the fixed electrode side on the contrary to the third aspect as the first insulating film. Thereby it is possible to increase the pressure generated in the electrostatic actuator. Moreover the second insulating film is the thermally oxidized silicon film so that the sufficient joint strength and dielectric strength voltage higher than those of the fifth aspect can be secured. The same advantageous effect as the fifth aspect concerning the stability and endurance in the driving of the electrostatic actuator can be obtained for the sixth aspect of the invention. Furthermore it is possible to manufacture the electrostatic actuator at a lower cost compared to the fifth aspect of the invention since it is easier to fabricate the silicon substrate according to the sixth aspect of the invention in terms of manufacturing process compared to the fifth aspect of the invention.

It is preferable that the surface protection film be made of a carbon-based material such as diamond and diamond-like carbon. The diamond-like carbon is most preferable for the surface protection film because it has a fine adhesion with the insulating film, a highly smooth and low friction surface.

It is also preferable that the dielectric material whose relative permittivity is higher than the relative permittivity of the silicon oxide be selected at least from the group including aluminum oxide ($Al_2O_3$), hafnium oxide ($HfO_2$), hafnium silicate nitride (HfSiN) and hafnium silicate oxynitride (HfSiON).

It is preferable that the silicon oxide films of the first insulating film and the second insulating film be formed on a joint face of the glass substrate and the silicon substrate in terms of the joint strength.

In this case, a part of the surface protection film situated in a joint part of the glass substrate or the silicon substrate is preferably removed because the surface protection film made of the carbon-based material such as diamond and diamond-like carbon cannot be easily anodically bonded.

It is preferable that the sealing of the gap be performed under nitrogen atmosphere after heat vacuuming for removing the moisture in the gap is conducted. In this way, moisture or water will not exist in the gap in other words on the insulating film and on the surface protection film in the electrostatic actuator thereby it is prevented that the movable electrode remains sticking to the fixed electrode by the electrostatic force.

A droplet discharge head according to a seventh aspect of the invention includes, a nozzle substrate having a single nozzle opening or a plurality of nozzle openings for discharging a droplet, a cavity substrate in which a concave portion is formed, the concave portion serving as a discharge chamber that communicates with the nozzle opening, an electrode substrate on which an individual electrode of a fixed electrode is formed, the individual electrode opposing a vibration plate of a movable electrode with a predetermined gap therebetween and the movable electrode being formed at the bottom of the discharge chamber, and the above-described electrostatic actuator.

According to the seventh aspect of the invention, the droplet discharge head has the above-described electrostatic actuator that has a high stability and endurance in driving and is capable of generate a high pressure. Therefore it is possible to obtain a highly reliable droplet discharge head with a fine droplet discharge characteristic.

According to an eighth aspect of the invention, a method for manufacturing a droplet discharge head that includes a nozzle substrate having a single nozzle opening or a plurality of nozzle openings for discharging a droplet, a cavity substrate in which a concave portion is formed, the concave portion serving as a discharge chamber that communicates with the nozzle opening, an electrode substrate on which an individual electrode of a fixed electrode is formed, the individual electrode opposing a vibration plate of a movable electrode with a predetermined gap therebetween, and the movable electrode being formed at the bottom of the discharge chamber, includes the above-described method for manufacturing an electrostatic actuator.

In this way it is possible to manufacture a highly reliable and densely arranged droplet discharged head with a fine droplet discharge characteristic at low cost.

A droplet discharge apparatus according to a ninth aspect of the invention includes the above-described droplet discharge head so that it is possible to realize a high-resolution, high-density and high-speed ink-jet printer and the like.

BRIEF DESCRIPTION OF THE DRAWINGS

The invention will be described with reference to the accompanying drawings, wherein like numbers reference like elements.

DESCRIPTION OF EXEMPLARY EMBODIMENTS

A droplet discharge head having an electrostatic actuator according to an embodiment of the invention is firstly described with reference to the accompanying drawings. Here, as the electrostatic driving type ink-jet head, a face discharge type ink-jet which discharges ink droplets from nozzle openings provided on the surface of a nozzle substrate is described with reference to FIGS. 1-5. The invention is obviously not limited to the specific embodiments described herein, but also encompasses any variations that may be considered by any person skilled in the art, within the general scope of the invention. For example, the invention can be applied to an ink-jet head having a four-layered substrate structure in which a discharge chamber and a reservoir part are separately provided in different substrates. The invention can also be applied to an edge-discharge type droplet discharge head that discharges ink droplets from nozzle openings provided on the edge of the substrate.

First Embodiment

Figure 1:
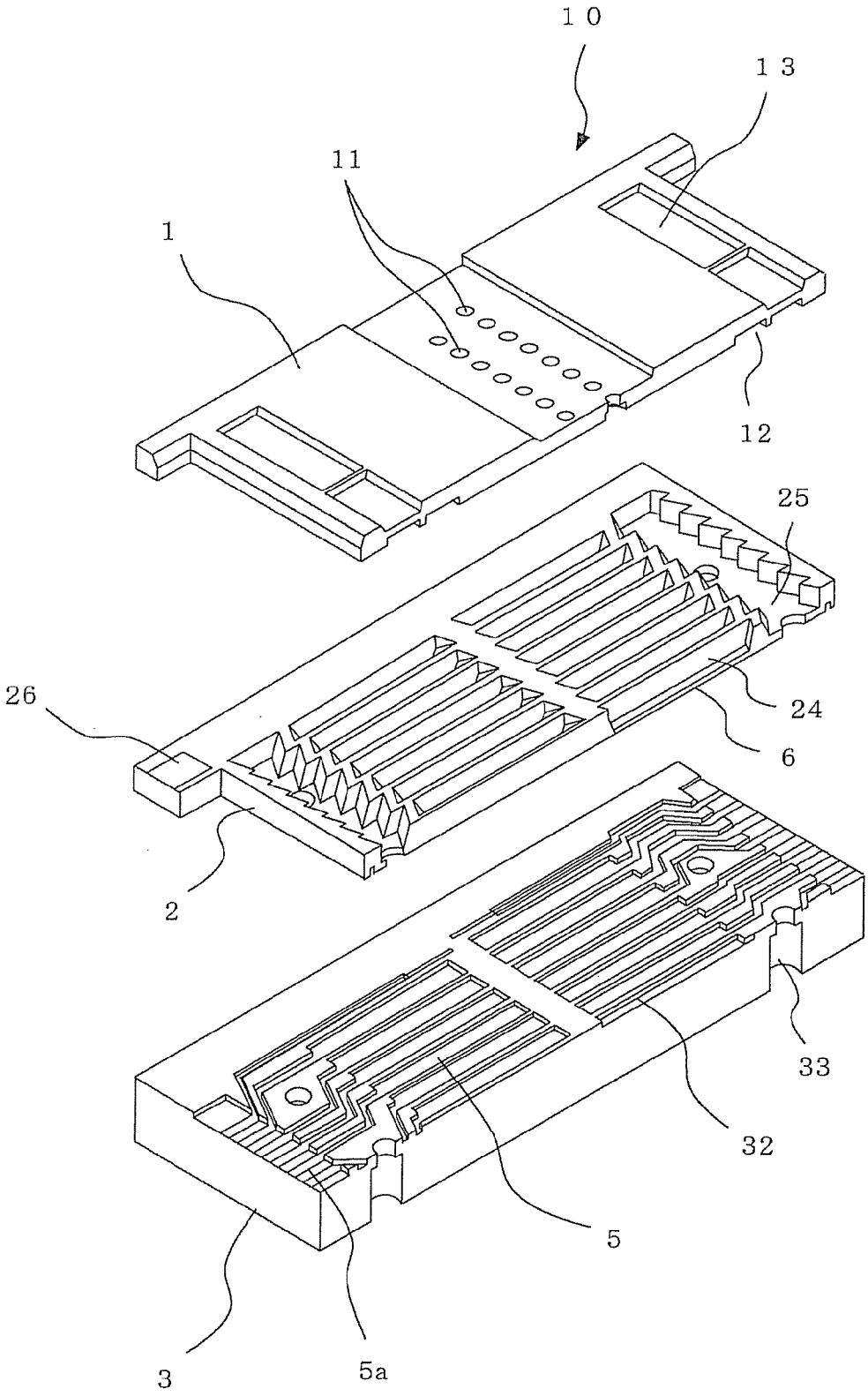
FIG. 1 is an exploded perspective view of an ink-jet head according to a first embodiment of the invention.
Figure 2:
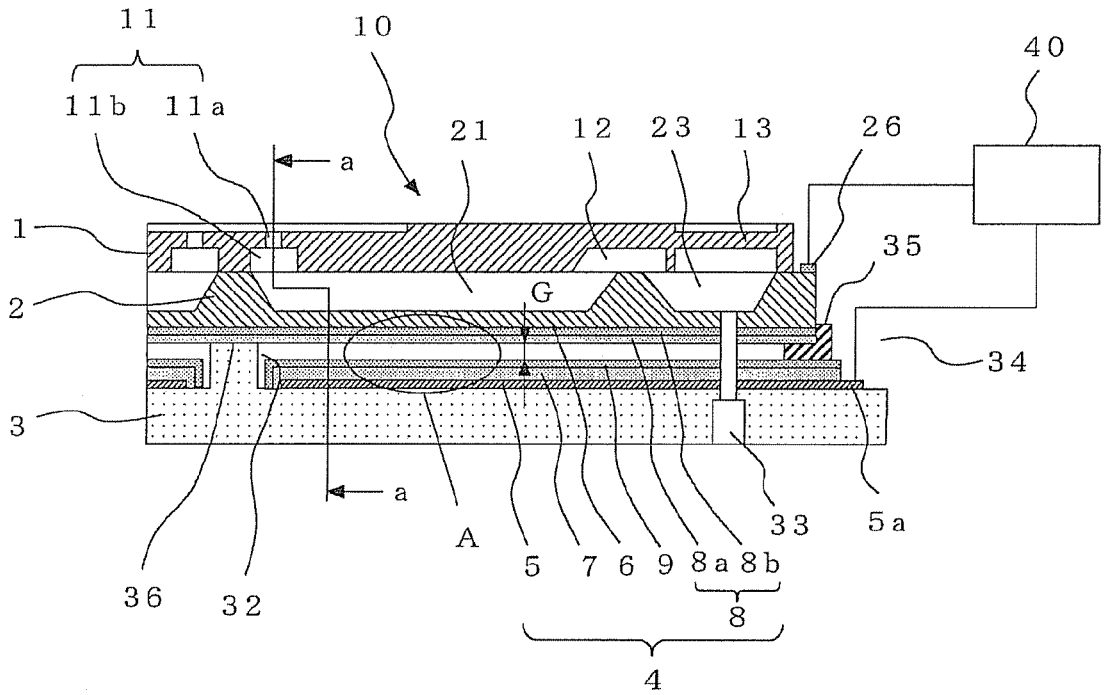
FIG. 2 is a sectional view of the ink-jet head in an assembling state showing its schematic structure of the right half part shown in FIG. 1.
Figure 3:
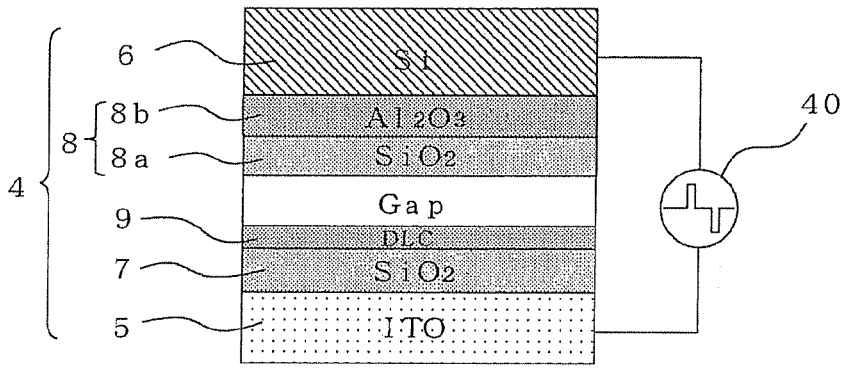
FIG. 3 is an enlarged sectional view of the part "A" shown in FIG. 2.
Figure 4:
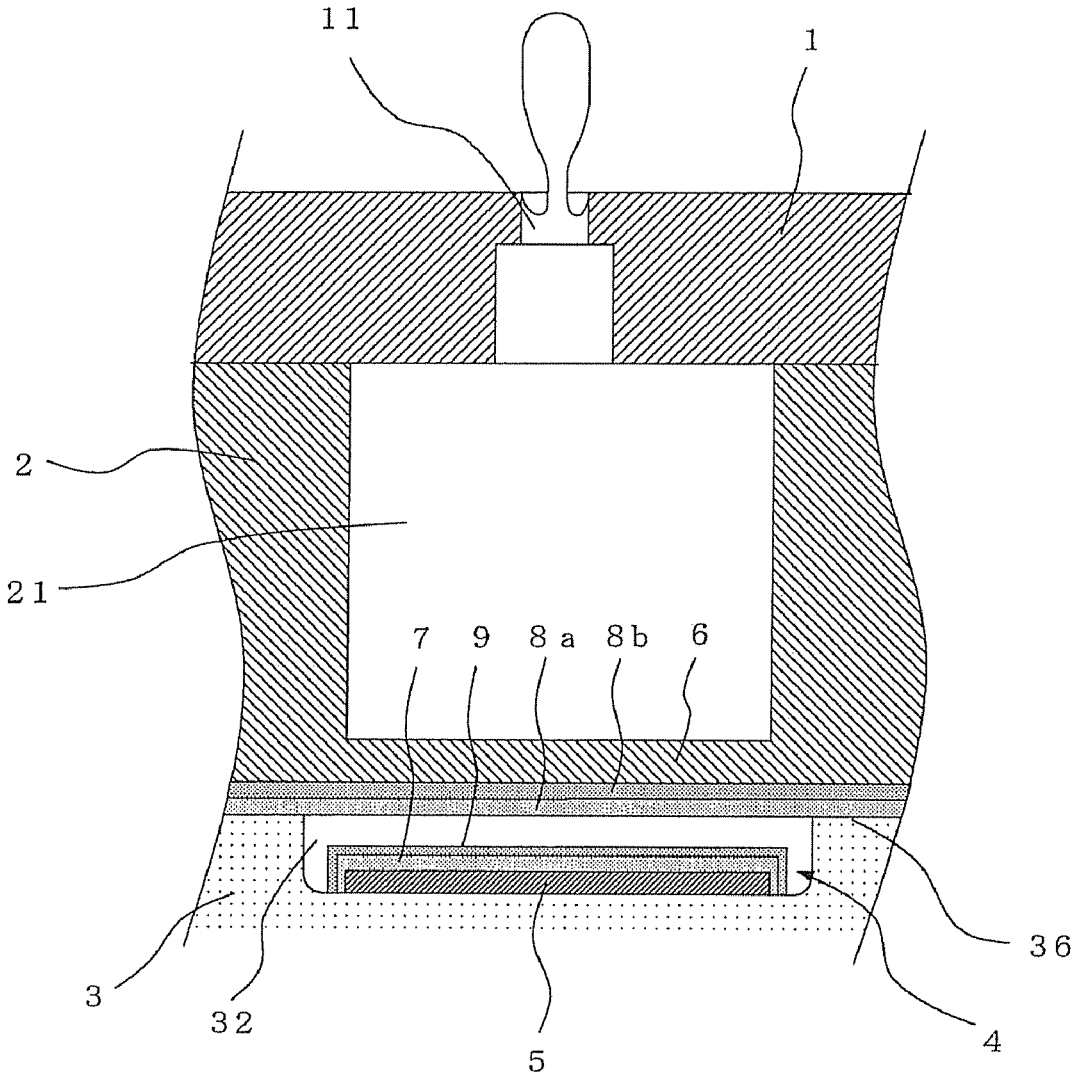
FIG. 4 is an enlarged sectional view along the line a-a in FIG. 2.
Figure 5:
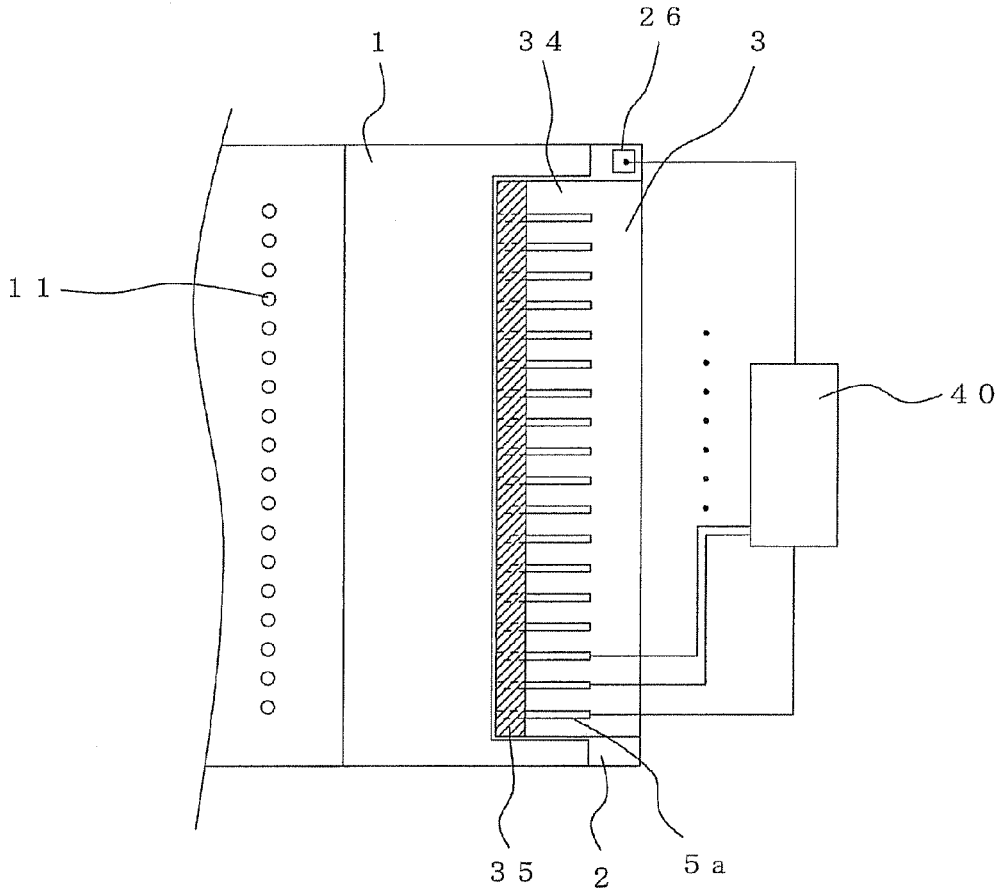
FIG. 5 is a top view of the ink-jet head shown in FIG. 2.

FIG. 1 is an exploded perspective view of an ink-jet head according to a first embodiment of the invention. A part of the ink-jet head is shown in section in FIG. 1. FIG. 2 is a sectional view of the ink-jet head showing its schematic structure of the right half part in an assembling state. FIG. 3 is an enlarged sectional view of the part "A" shown in FIG. 2. FIG. 4 is an enlarged sectional view along the line a-a in FIG. 2. FIG. 5 is a top view of the ink-jet head shown in FIG. 2. The ink-jet head in FIG. 1 and FIG. 2 is depicted upside down from the normally used condition.

Referring to FIG. 1 and FIG. 2, an ink-jet head 10 (an example of the droplet discharge head) according to the first embodiment has a nozzle substrate 1, a cavity substrate 2 and an electrode substrate 3, and these substrates are adhered together. A nozzle opening 11 is provided in a predetermined pitch and in the plural number in the nozzle substrate 1. An ink supply channel is respectively formed to each nozzle opening 11 in the cavity substrate 2. An individual electrode 5 is provided in the electrode substrate 3 so as to oppose a vibration plate 6 which is provided in the cavity substrate 2.

An electrostatic actuator part 4 is provided with respect to the nozzle opening 11 of the ink-jet head 10. Referring to FIGS. 2-4, the electrostatic actuator part 4 includes the individual electrode 5 formed in a concave portion 32 of the electrode substrate 3 which is made of glass, a bottom wall of a discharge chamber 21 formed in the cavity substrate 2 which is made of silicon, and the vibration plate 6 which is placed so as to oppose the individual electrode 5 with a predetermined gap G therebetween. A fixed electrode in the actuator here is the individual electrode 5 and a movable electrode is the bottom wall of the discharge chamber 21. A first insulating film 7 is formed on an opposing face (the face closer to the vibration plate) of each individual electrode 5. A second insulating film 8 is formed on an opposing face (the face closer to the individual electrode) of the vibration plate 6 in other words on the whole face of the cavity substrate 2 where the electrode substrate 3 is adhered. Furthermore, a surface protection film 9 is formed on at least one of the insulating films, for example on the first insulating film 7.

In the electrostatic actuator according to the embodiment of the invention, the insulating films are formed on the both opposing faces of the individual electrode 5 and the vibration plate 6, and at least one of the first insulating film 7 formed on the individual electrode 5 and the second insulating film 8 formed on the vibration plate 6 has a layered structure including a silicon oxide ($SiO_2$) layer and a layer made of a material whose dielectric constant is higher than that of the silicon oxide. Moreover the surface protection film 9 that protects the insulating film is formed on at least one or both of the first and second insulating films 7, 8.

The material whose dielectric constant is higher than that of the silicon oxide ($SiO_2$), in other words the High-k material, includes for example silicon oxynitride (SiON), aluminum oxide ($Al_2O_3$, alumina), hafnium oxide ($HfO_2$), tantalum oxide ($Ta_2O_3$), hafnium silicate nitride (HfSiN), hafnium silicate oxynitride (HfSiON), aluminum nitride (AlN), zirconium nitride (ZrN), cerium oxide ($CeO_2$), titanium oxide ($TiO_2$), yttrium oxide ($Y_2O_3$), zirconium silicate (ZrSiO), hafnium silicate (HfSiO), zirconium aluminate (ZrAlO), nitrogenized hafnium aluminate (HfAlON) and composite films thereof. Considering a low-temperature film formation property, homogeneity in the film, process adaptability and so on, it is preferable to use the aluminum oxide ($Al_2O_3$, alumina), the hafnium oxide ($HfO_2$), the hafnium silicate nitride (HfSiN) and the hafnium silicate oxynitride (HfSiON). At least one of the above-mentioned preferred materials is used as the High-k material according to the embodiment. In this first embodiment, the first insulating film 7 provided on the individual electrode 5 side has a monolayer structure of an silicon oxide film. The second insulating film 8 has the double layered structure in which an alumina film 8*b* is formed on the bottom and a silicon oxide film 8*a* is formed on top of the alumina film 8*b*.

Ceramics based hard films made of TiN, TiC, TiCN, TiAlN or the like and carbon based hard films made of diamond, diamond like carbon (DLC) or the like can be used to form the surface protection film 9. Especially the DLC is preferable because the DLC has a good adhesion with the silicon oxide film that will be provided as a base insulating film. The first embodiment and the embodiments described hereunder adopted the DLC to form the surface protection film. As for the thickness of each film, the silicon oxide film of the first insulating film 7 is 40 nm, the silicon oxide film 8*a* of the second insulating film 8 is 40 nm, the alumina film 8*b* of the second insulating film 8 is 40 nm, and the DLC film of the surface protection film 9 is 5 nm. The gap G is 200 nm and the thickness of the individual electrode 5 made of indium tin oxide (ITO) is 100 nm.

The cavity substrate 2 made of silicon is anodically bonded with the electrode substrate 3 made of glass with the silicon oxide film 8*a* interposed therebetween. Referring to FIG. 2, FIG. 3 and FIG. 5, a driving control circuit 40 including a driver IC and the like is coupled through wirings to a terminal part 5*a* of the individual electrode 5 that is formed on the electrode substrate 3 and to a common electrode 26 that is formed on the surface of the cavity substrate 2 where is opposite to the bonded face.

The electrostatic actuator part 4 of the ink-jet head 10 has the above-described structure.

The structure of each substrate is now described in detail.

The nozzle substrate 1 is made of for example a silicon substrate. The nozzle opening 11 through which ink droplets are discharged has two different diameter cylindrical part, which is an injection part 11*a* having a small diameter and a feed part 11*b* having a large diameter. The injection part 11*a* and the mall diameter and a feed part 11*b* are provided coaxially and perpendicular to the substrate surface. The tip of the injection part 11*a* opens in the front face of the nozzle substrate 1. The feed part 11*b* opens in the back face (the joint face with the cavity substrate 2) of the nozzle substrate 1.

An orifice 12 that couples the discharge chamber 21 with a reservoir 23 provided in the cavity substrate 2 is formed in the nozzle substrate 1. A diaphragm 13 that compensates the pressure variation in the reservoir 23 is also formed in the nozzle substrate 1.

Because the nozzle opening 11 has the two-step structure which is the injection part 11*a* and the feed part 11*b* having a larger diameter than that of the injection part 11*a*, the directions in which ink droplets are discharged can be directed to the central axis of the nozzle opening 11. Thereby it is possible to obtain a stable ink discharge characteristic. This means that variation in the discharged directions of the ink droplets becomes small, the ink droplets will not be scattered, and the variation in the amount of the ink droplet discharged is made small. In addition, it is possible to increase the density of the nozzles provided there.

The cavity substrate 2 is made of for example a silicon substrate with the plane direction (110). A concave portion 22 that serves as the discharge chamber 21 provided in the ink flow passage and a concave portion 24 that serves as the reservoir 23 are formed in the cavity substrate 2 by etching. The concave portion 22 is situated at the position where corresponds to the nozzle opening 11 and provided in the plural number. When the nozzle substrate 1 and the cavity substrate 2 are jointed together, each concave portion 22 forms the discharge chamber 21 and communicates with the nozzle opening 11, and the concave portion 22 also communicates with the orifice 12 which is an ink feed opening as shown in FIG. 2. The bottom part of the discharge chamber 21 (the concave portion 22) serves as the vibration plate 6.

The vibration plate 6 can be obtained by diffusing Boron (B) in the surface of the silicon substrate to form a boron diffused layer and conducting etching stop of the substrate by wet-etching such that the substrate becomes as thin as the thickness of the boron diffused layer. The insulating film including the alumina film 8*b* and the silicon oxide film 8*a* provided on top of the alumina film 8*b* is formed as the second insulating film 8 on the opposing face of the vibration plate 6 as described above.

The concave portion 24 is provided for temporally storing a liquid material such as ink. The concave portion 24 serves as the reservoir 23 (a common ink chamber) to which the discharge chambers 21 are commonly coupled. The reservoir 23 (the concave portion 24) communicates with every discharge chamber 21 through the corresponding orifice 12. An opening that penetrates the hereunder-described electrode substrate 3 is provided at the bottom of the reservoir 23. Ink is supplied from an unshown ink-cartridge through this ink feed opening 33.

The electrode substrate 3 is made of for example a glass substrate. A borosilicate-based heat-resistant hard glass whose thermal expansion coefficient is close to that of the silicon substrate is particularly preferred for the electrode substrate. This is because the stress caused at the time of the anionic bonding of the electrode substrate 3 and the cavity substrate 2 can be reduced when the thermal expansion coefficient is close each other. Accordingly, the electrode substrate 3 and the cavity substrate 2 can be firmly adhered each other without any trouble such as detachment.

The concave portion 32 is formed in the surface of the electrode substrate 3 at the position corresponding to each vibration plate 6 of the cavity substrate 2. The concave portion 32 is formed in a predetermined depth by etching. The individual electrode 5 that is usually made of ITO and has a thickness of for example 100 nm is formed in each concave portion 32. The first insulating film 7 made of the silicon oxide (the TEOS-$SiO_2$ film) is formed on the individual electrode 5 with a predetermined thickness, and the surface protection film 9 made of the DLC is formed to have a predetermined thickness on the first insulating film 7. According to such structure, the gap G between the vibration plate 6 and the individual electrode 5 is determined by the depth of the concave portion 32 and the film thicknesses of the individual electrode 5, the first insulating film 7, the second insulating film 8 and the surface protection film 9. The size of the gap G largely affects the discharging characteristic of the ink-jet head therefore it is necessary to accurately fabricate the concave portion 32, the individual electrode 5, the first insulating film 7, the second insulating film 8 and the surface protection film 9 with appropriate thicknesses.

Chemical compound typically used for the surface protection film puts enormous film stress onto the base insulating film. In order to prevent the surface protection film from being detached from the base insulating film, it is preferable that the surface protection film 9 is formed as thin as possible. More specifically, the film thickness of the surface protection film 9 is preferably equal or smaller than 10% of the thickness of the base insulating film.

The individual electrode 5 has the terminal part 5*a* to which a flexible wiring substrate (unshown in the drawings) is coupled. Referring to FIG. 2 and FIG. 5, the surface protection film 9 and the first insulating film 7 formed on the terminal part 6*a* are removed for the wiring. The terminal part 5*a* is exposed in an electrode exposed part 34 where the edge of, the cavity substrate 2 is cut out to be open.

The open end of the gap G between the vibration plate 6 and the individual electrode 5 is air-tightly closed with a sealant material 35. In this way, it is possible to prevent moisture, dust and the like from coming into the electrode gap. Consequently it is possible to maintain the reliability of the ink-jet head 10.

As described above, the main body of the ink-jet head 10 is formed by adhering the nozzle substrate 1, the cavity substrate 2 and the electrode substrate 3 as shown in FIG. 2. More specifically, the cavity substrate 2 and the electrode substrate 3 are anodically bonded each other and the nozzle substrate 1 is adhered onto the upper face (the upper face in FIG. 2) of the cavity substrate 2 with adhesive or the like.

Finally the driving control circuit 40 including the driver IC and the like is coupled to the terminal part 5*a* of each individual electrode 5 and to the common electrode 26 on the cavity substrate 2 through the above-mentioned flexible wiring substrate (not shown in the drawings), which can be schematically shown in FIG. 2 and FIG. 5.

The ink-jet head is completed through the above-described assembling process.

Operation of the ink-jet head 10 having the above-described structure is now described.

When pulse voltage is applied between the individual electrode 5 and the common electrode 26 on the cavity substrate 2 by the driving control circuit 40, the vibration plate 6 is attracted toward the individual electrode 5 and a negative pressure is generated in the discharge chamber 21. The ink in the reservoir 23 is suctioned by the negative pressure and the ink is oscillated (meniscus oscillation). When the voltage is turned off at the point where the ink oscillation becomes substantially greatest, the vibration plate 6 is released and the ink is then pushed out from the nozzle 11. In this way, the ink droplets are discharged.

At this point, the vibration plate 6 is drawn toward the individual electrode 5, and the second insulating film 8 having the layered structure of the silicon oxide film 8*a* and the alumina film 8*b* formed on the opposing face of the vibration plate 6, the first insulating film 7 formed of the silicon oxide (the TEOS-$SiO_2$ film) on the opposing face of the individual electrode 5, and the surface protection film 9 formed of the DLC on top of the first insulating film 7 exist between the vibration plate 6 and the individual electrode 5. In other words, the vibration plate 6 repeatedly contacts and leaves the surface protection film 9 on the individual electrode 5 side with the above-mentioned insulating films interposed therebetween. The surface protection film 9 will be suffered form the stress by the repeat contact. However the surface protection film 9 is made of the hard film DLC and the DLC hard film can reduce the friction because the DLC has a fine adhesion with the silicon oxide film which is the base insulating film and the surface of the DLC is highly flat and smooth. Therefore the surface protection film 9 will not be affected by the friction and the like and will not be broken away. Through the first insulating film 7 of the individual electrode 5 is made of the typically used TEOS-$SiO_2$ film, its surface is protected by the DLC hard film so that the TEOS-$SiO_2$ film is less affected and it is possible to maintain the insulating property, adhesion and the like of the TEOS-$SiO_2$ film.

In addition, since the ink-jet head 10 has such electrostatic actuator part 4, the ink-jet head can have a fine endurance and stability in its driving, moreover the high-speed driving of the ink-jet head and the highly dense arrangement in the ink-jet head become possible.

The pressure generated in the electrostatic actuator having the insulating films is explained.

A electrostatic pressure (generated pressure) P by which the vibration plate 6 is pulled up at the time of the driving can be represented by the following formula, $$P(x) = \frac{1}{S}\frac{\partial E(x)}{\partial x} = -\frac{\varepsilon_0}{2}\frac{V^2}{\left(\frac{t}{\varepsilon_r} + x\right)^2} \qquad \text{Formula 1}$$

where E is an electrostatic energy, x is a position of the vibration plate 6 with respect to the individual electrode 5, S is the area of the vibration plate 6, V is the applied voltage, t is the thickness of the insulating film, $\in_0$ is the permittivity of free space, and $\in_r$ is the relative permittivity of the insulating film.

An average pressure Pe at the time when the vibration plate 6 is driven is given by the following formula, $$P_e = \frac{1}{d}\int_0^d P(x) = \frac{\varepsilon_0\varepsilon_r}{2}\frac{V^2}{t\left(\frac{t}{\varepsilon_r} + d\right)} \qquad \text{Formula 2}$$

where d is a distance between the vibration plate 6 and the individual electrode 5 when the vibration plate 6 is not driven.

Where insulating films made of different materials, for example the silicon oxide and the alumina, are provided, the average pressure Pe in the electrostatic actuator is given by the following formula, $$P_e = \frac{\varepsilon_0 V^2}{2\left(\frac{t_1}{\varepsilon_1} + \frac{t_2}{\varepsilon_2}\right)\left(d + \frac{t_1}{\varepsilon_1} + \frac{t_2}{\varepsilon_2}\right)} \qquad \text{Formula 3}$$

where $t_1$ is the film thickness of the silicon oxide, $t_2$ is the film thickness of the alumina, $\in_1$ is the relative permittivity of the silicon oxide, and $\in_2$ is the relative permittivity of the alumina. The formula 3 can be derived from the formula 2. In case of the surface protection film 9 of the DLC, the average pressure Pe is given by the following formula, $$P_e = \frac{\varepsilon_0 V^2}{2\left(\frac{t_1}{\varepsilon_1} + \frac{t_2}{\varepsilon_2} + \frac{t_3}{\varepsilon_3}\right)\left(d + \frac{t_1}{\varepsilon_1} + \frac{t_2}{\varepsilon_2} + \frac{t_3}{\varepsilon_3}\right)} \quad \text{Formula 3A}$$

where $t_3$ is the film thickness of the DLC and $\in_3$ is the relative permittivity of the DLC.

The formula 2 shows that the larger the relative permittivity of the insulating film is or the smaller the ratio of the insulating film thickness to the relative permittivity ($t/\in$) is, higher the average pressure Pe becomes. Therefore the pressure generated in the electrostatic actuator can be made higher with the insulating film made of the High-K material whose relative permittivity is larger than that of the silicon oxide.

Accordingly, the ink-jet head 10 in which the High-K material is used for the insulating film can gain a sufficient power to discharge ink droplets even if the area of the vibration plate 6 is made smaller. Consequently, the pitch of the discharge chamber 21 or the nozzle 11 in the ink-jet head 10 can be made smaller by making the width of the vibration plate 6 smaller, which means that the resolution can be increased. In this way it is possible to obtain the ink-jet head 10 that can perform a high-speed and high-resolution printing. Moreover, the responsiveness in the ink flow passage can be improved by making the length of the vibration plate 6 shorter, and this allows the driving frequency to be increased. Consequently a faster printing becomes possible.

When the relative permittivity of the second insulating film 8 is made for example double as a whole, the same pressure can be generated even with the second insulating film 8 whose thickness is doubled. This means that the dielectric breakdown strength against a time depend dielectric breakdown (TDDB), a time zero dielectric breakdown (TZDB) and the like can be made substantially double.

Characteristics of the insulating films and the surface protection film used in the first through eleventh embodiments are shown in the following table. It can tell from Table 1 that the relative permittivity of the alumina ($Al_2O_3$) and the hafnium oxide ($HfO_2$) is significantly larger than that of the silicon oxide ($SiO_2$). Thereby it is possible to enhance the pressure generated in the electrostatic actuator with the insulating film made of the high permittivity material such as the alumina and the hafnium oxide.

TABLE 1

Insulating film characteristics comparison

| Insulating film | Relative permittivity | Dielectric strength voltage | Joint strength |
|---|---|---|---|
| $SiO_2$ | 3.8 | 8 MV/cm | ◎ |
| $Al_2O_3$ | 7.8-8 | 6 MV/cm | △ |
| $HfO_2$ | 18.0-24 | 4 MV/cm | X |
| DLC | 3-5 | Less than 1 MV/cm | X |

It can be understood from the formula 2 that the parameter that relates to the improvement of the pressure generated by the electrostatic actuator is the ratio of the relative permittivity to the thickness of the insulating film ($t/\in$). Where the insulating film is made of two different materials like the one described in the first embodiment, the parameter is the sum of each film's ratio of the relative permittivity to the thickness of the insulating film ($t_1/\in_1 + t_2/\in_2$). The calculated values of the parameter are shown in the following table.

TABLE 2

| | Typical insulating film ($SiO_2$: 110 nm) | First Embodiment ($SiO_2$: 80 nm, $Al_2O_3$: 40 nm, DLC: 5 nm) |
|---|---|---|
| $t/\epsilon$ ($t_1/\epsilon_1 + t_2/\epsilon_2 + t_3/\epsilon_3$) | 28.95 | 27.43 |

The table 2 shows the calculated values of the parameter in cases of the typical insulating film and the first example. The suffix "1" of $t,\in$ denotes the silicon oxide, the suffix "2" denotes the alumina and "3" denotes the DLC. The typical insulating film here is the insulating film that is made of only silicon oxide and has a thickness of 110 nm. The insulating film described in the first embodiment includes the first and the second insulating films in which the total thickness of the silicon oxide film is 80 nm, the thickness of the alumina film in the second insulating film is 40 nm, and the thickness of the DLC is 5 nm. The calculation of the parameter in the case of the first embodiment is conducted with the following relative permittivities: 3.8 for the silicon oxide, 7.8 for the alumina, 18.0 for the hafnium oxide, and 4.0 for the DLC.

In the electrostatic actuator according to the first embodiment, the second insulating film 8 on the side of the vibration plate 6 is made of the alumina which is a high dielectric material as described above. Thereby the electrostatic actuator has the following advantageous effects compared to the typical electrostatic actuator in which the insulating film is made of only the silicon oxide.

1. The pressure generated in the actuator is increased. The value of $t/\in$can be made smaller as shown in the table 2 with the alumina film which is the High-k material, thereby the pressure generated in the actuator is increased.

2. The sufficient dielectric strength voltage is secured. The silicon oxide film and the alumina film that have the fine dielectric strength voltage are formed with a sufficient thickness so that it is possible to secure the required dielectric strength voltage.

3. The enough joint strength is secured. The silicon oxide film is formed on the High-k material. The cavity substrate and the electrode substrate are anodically bonded each other through the silicon oxide film so that the joint strength as large as the typical electrostatic actuator can be obtained. In addition, there is another advantage that it is possible to prevent moisture from entering into the actuator because the joint is conducted between the silicon oxides.

4. The driving endurance is improved. The DLC film is formed as the surface protection film on the first insulating film thereby it is possible to significantly improve the driving endurance of the electrostatic actuator.

5. The leak current can be decreased. The silicon oxide film is formed on the High-k material thereby the leak current can be reduced as much as the typical electrostatic actuator.

In the case where the DLC film is formed, it is preferable that the DLC film be formed on the glass substrate which is the electrode substrate 3 as described in the first example. There are two reasons for this. The first is that (a) the DLC film has a low joint strength so that the DLC film formed on the joint part of the cavity substrate 2 and the electrode substrate 3 (the glass substrate) has to be removed. To remove the DLC film, patterning is necessary. The patterning can be performed easily and securely when the DLC is formed on the glass substrate. The second reason is that (b) where the DLC is formed on the side of the vibration plate which is the thin film, the DLC has a high film stress so that the vibration plate can be warped and the plate will not contact partially even when the contact voltage which is required for the contact is applied. Whereas the case where the DLC film is formed on the glass substrate side, the thick glass substrate exists under the insulating film and the ITO film, therefore the vibration plate is less affected by the stress compared with the case where the DLC film is formed on the vibration plate side.

Adding further explanation to the first reason, where the DLC film is formed on for example the vibration plate side, a highly-accurate patterning is required to completely remove the DLC film exiting in the joint part. If the DLC film is removed only in the area smaller than the joint part area and a small amount of the DLC film is remained, the joint strength of the actuator can be partially deteriorated by the remained film. If the DLC film is removed only in the area larger than the joint part area, there is a possibility that an insulating film exposed part which can contact with the corresponding individual electrode surface is formed, and this can shorten the longevity of the actuator because of the stress concentration in the vibration plate and the like.

Whereas the DLC film is formed on the glass substrate side, the DLC film exiting in the joint part can be completely removed by patterning. Moreover the DLC film in the area corresponding to the individual electrode is situated below the surface so that the DLC film in that part can be easily removed. Accordingly it is possible to secure the joint strength of the actuator more reliably and easily. For this reason, where the DLC film is used as the surface protection film, it is preferable that the DLC film is formed on the glass substrate side.

Referring to FIG. 1, the DLC film is formed of the part formed on the surface of the first insulating film 7 on the opposing face of the individual electrode 5 or/and the part formed on the surface of the second insulating film 8 on the opposing face of the vibration plate 6. These parts are separately fabricated.

Second Embodiment

Figure 6:
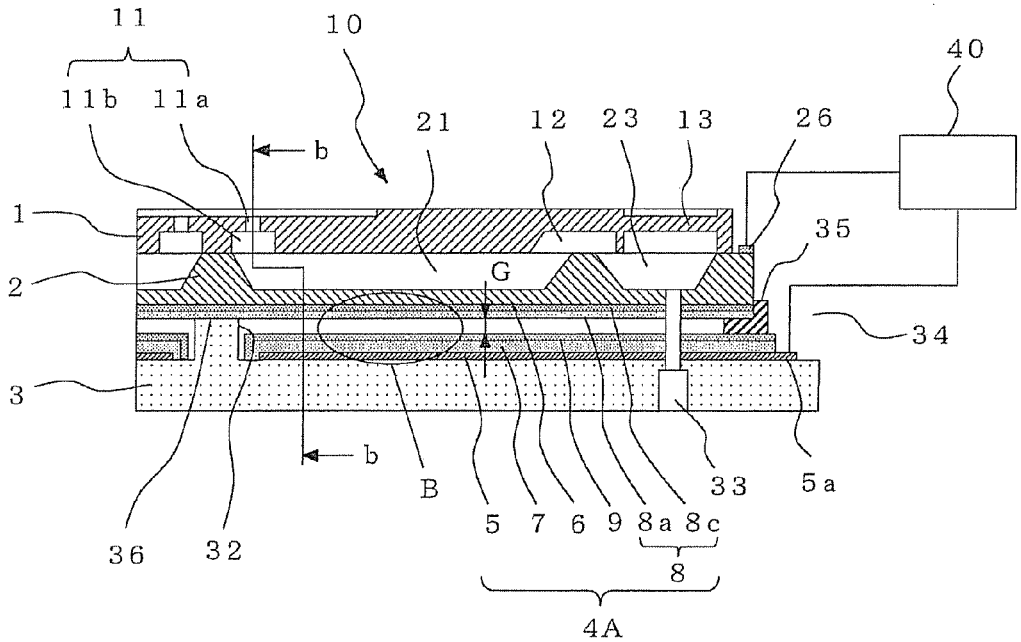
FIG. 6 is a schematic sectional view of an ink-jet head according to a second embodiment.
Figure 7:
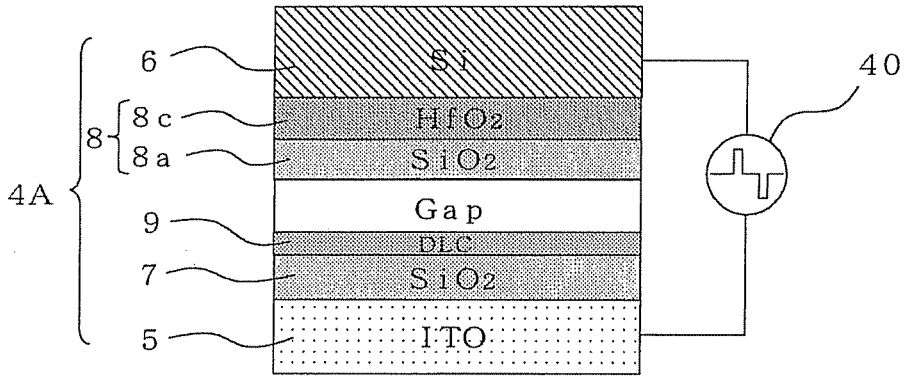
FIG. 7 is an enlarged sectional view of the part "B" shown in FIG. 6.
Figure 8:
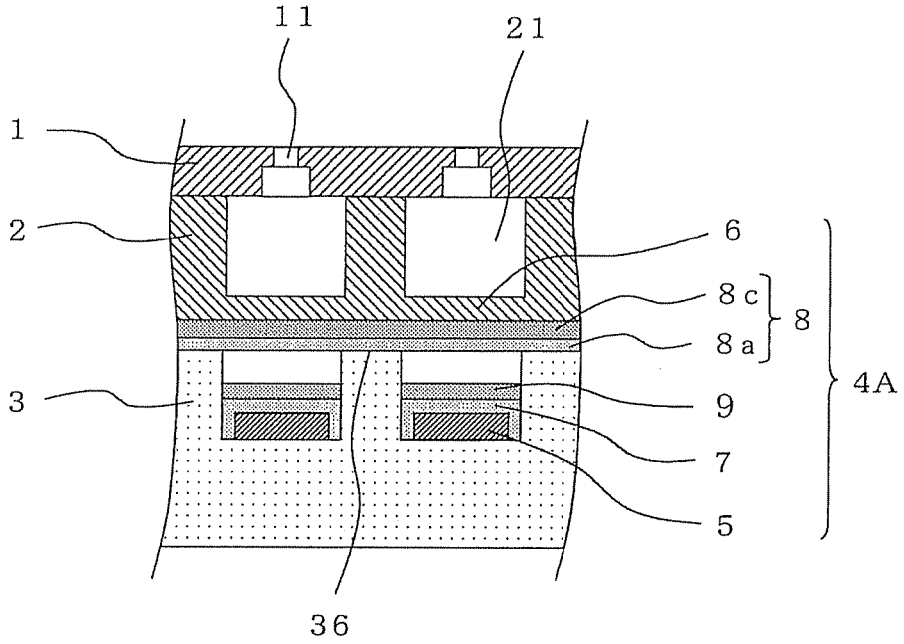
FIG. 8 is an enlarged sectional view along the line b-b in FIG. 6.

FIG. 6 is a schematic sectional view of an ink-jet head 10 according to a second embodiment. FIG. 7 is an enlarged sectional view of the part "B" shown in FIG. 6. FIG. 8 is an enlarged sectional view along the line b-b in FIG. 6. The identical numerals are given to the same components and parts described in the first embodiment unless otherwise noted and those explanations will be omitted.

An electrostatic actuator 4A according to the second embodiment has the second insulating film 8 which is made of a hafnium oxide instead of the alumina in the first embodiment. The second insulating film 8 provided on the vibration plate 6 side has a double-layered structure of a hafnium oxide film 8*c* and an silicon oxide film 8*a*. The first insulating film 7 on the individual electrode 5 side is made of the silicon oxide in the same manner as the first embodiment and the surface protection film 9 made of DLC is provided on top of it.

As for the thickness of each film, the silicon oxide film of the first insulating film 7 is 40 nm, the hafnium oxide film 8*c* of the second insulating film 8 is 40 nm, the silicon oxide film 8*a* of the second insulating film 8 is 50 nm, and the DLC film of the surface protection film 9 is 5 nm. The gap G is 200 nm and the thickness of the individual electrode 5 is 100 nm.

The calculated values of the parameter (the ratio of the relative permittivity to the thickness of the insulating film) that relates to the improvement of the pressure generated in the electrostatic actuator according to the second embodiment are shown in the hereunder table 3. The suffix "1" of to denotes the silicon oxide, the suffix "2" denotes the hafnium oxide and "3" denotes the DLC in the table 3. The typical insulating film is the same insulating film in the table 2.

TABLE 3

| | Typical insulating film ($SiO_2$: 110 nm) | Second embodiment ($SiO_2$: 90 nm, $HfO_2$: 40 nm, DLC: 5 nm) |
|---|---|---|
| $t/\epsilon$ $(t_1/\epsilon_1 + t_2/\epsilon_2 + t_3/\epsilon_3)$ | 28.95 | 27.15 |

According to the second embodiment, the hafnium oxide whose relative permittivity is higher than that of the alumina is used as the second insulating film 8 provided on the vibration plate 6 side. And the insulating film has the double layered structure including the hafnium oxide film 8*c* and the silicon oxide film 8*a*. Thereby the value of t/∈ becomes small as shown in the table 3 and it is possible to increase the pressure generated by the electrostatic actuator compared with the first embodiment. The same advantageous effects as the first embodiment concerning the dielectric strength voltage, the joint strength, the driving endurance and the leak current can be obtained in the second embodiment.

Third Embodiment

Figure 9:
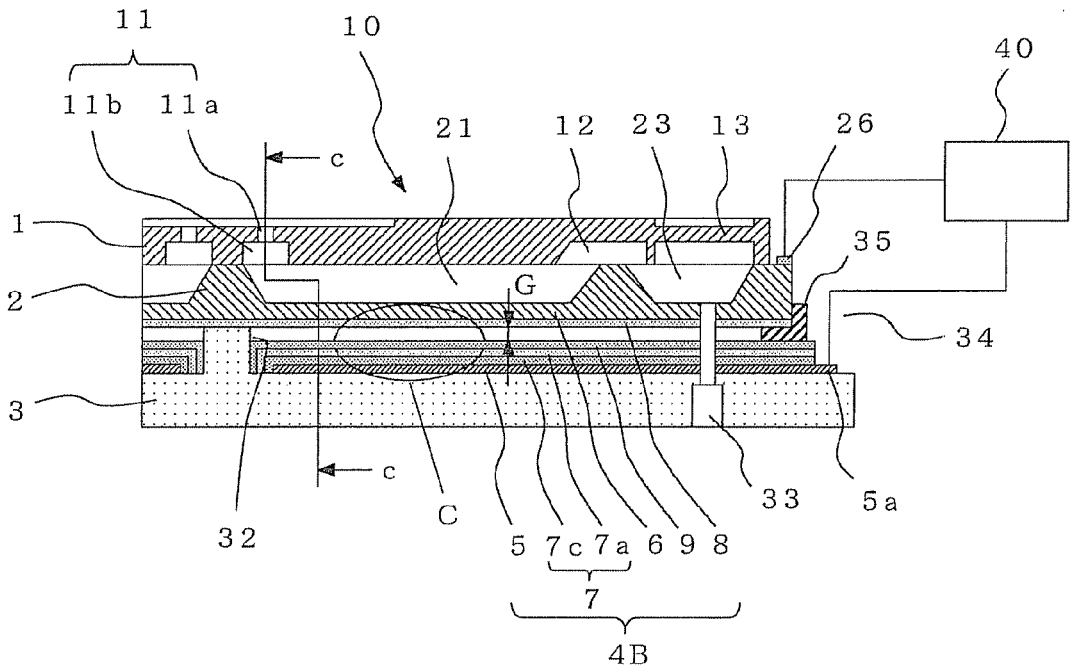
FIG. 9 is a schematic sectional view of an ink-jet head according to a third embodiment.
Figure 10:
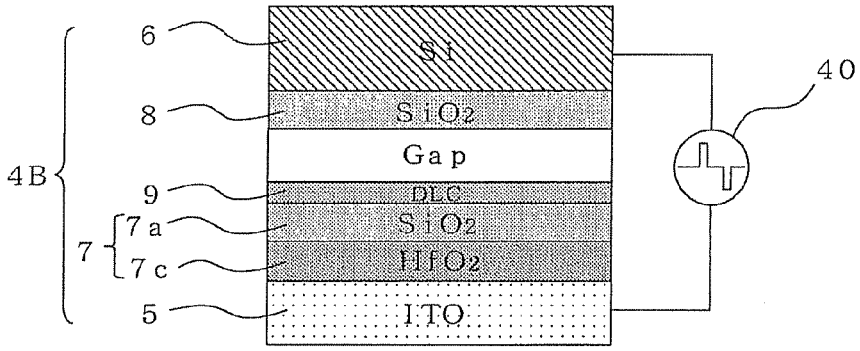
FIG. 10 is an enlarged sectional view of the part "C" shown in FIG. 9.
Figure 11:
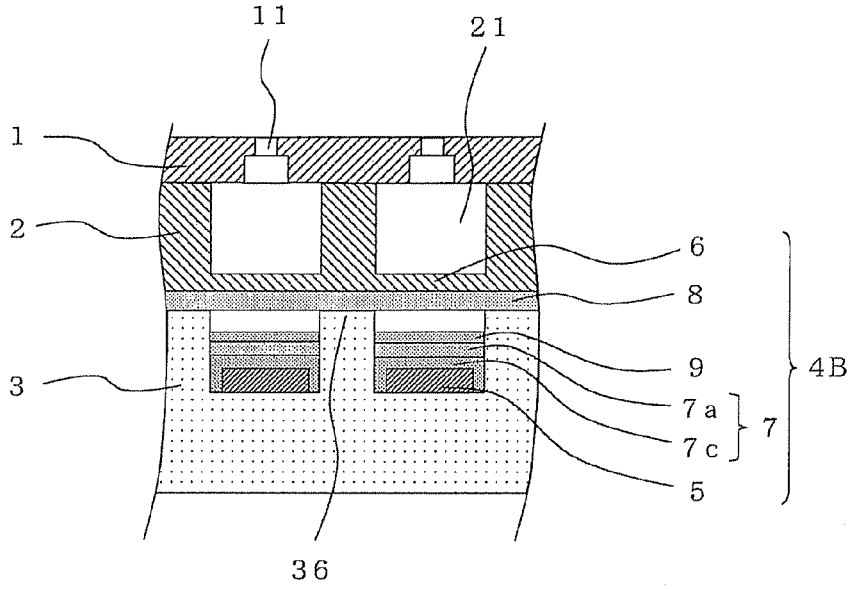
FIG. 11 is an enlarged sectional view along the line c-c in FIG. 9.

FIG. 9 is a schematic sectional view of an ink-jet head 10 according to a third embodiment. FIG. 10 is an enlarged sectional view of the part "C" shown in FIG. 9. FIG. 11 is an enlarged sectional view along the line c-c in FIG. 9.

An electrostatic actuator 4B according to the third embodiment has the insulating film whose structure is switched with the other film with respect to the second embodiment. More specifically, the first insulating film 7 on the individual electrode 5 side has the layered structure of a hafnium oxide film 7*c* and a silicon oxide film 7*a*. The surface protection film 9 made of the DLC is provided on top of the silicon oxide film 7*a*. The second insulating film 8 provided on the vibration plate 6 side is made of the thermally oxidized silicon film.

As for the thickness of each film, the hafnium oxide film 7*c* of the first insulating film 7 is 40 nm, the silicon oxide film 7*a* of the first insulating film 7 is 40 nm, the thermally oxidized silicon film of the second insulating film 8 is 50 nm, and the DLC film of the surface protection film 9 is 5 nm. The gap G is 200 nm and the thickness of the individual electrode 5 is 100 nm.

The calculated values of the parameter (the ratio of the relative permittivity to the thickness of the insulating film) that relates to the improvement of the pressure generated by the electrostatic actuator according to the third embodiment are shown in the hereunder table 4. The suffix "1" of t,∈ denotes the silicon oxide, the suffix "2" denotes the hafnium oxide and "3" denotes the DLC in the table 4. The typical insulating film is the same insulating film in the table 2.

TABLE 4

| | Typical insulating film ($SiO_2$: 110 nm) | Third embodiment ($SiO_2$: 90 nm, $HfO_2$: 40 nm, DLC: 5 nm) |
|---|---|---|
| $t/\epsilon$ $(t_1/\epsilon_1 + t_2/\epsilon_2 + t_3/\epsilon_3)$ | 28.95 | 27.15 |

According to the third embodiment, the hafnium oxide which has the high relative permittivity is used like the second embodiment. Thereby it is possible to increase the pressure generated by the electrostatic actuator compared with the first embodiment. Moreover the thermally oxidized silicon film that has the fine dielectric strength voltage is formed with a sufficient thickness on the vibration plate side. Therefore the dielectric strength voltage can be increased. The same advantageous effects as the first embodiment concerning the joint strength, the driving endurance and the leak current can also be obtained in the third embodiment.

Though the DLC film which is the surface protection film 9 is formed on the first insulating film 7 on the individual electrode 5 side in the third embodiment, the DLC film can be formed on the thermally oxidized silicon film which is the second insulating film 8 provided on the vibration plate 6 side.

Fourth Embodiment

Figure 12:
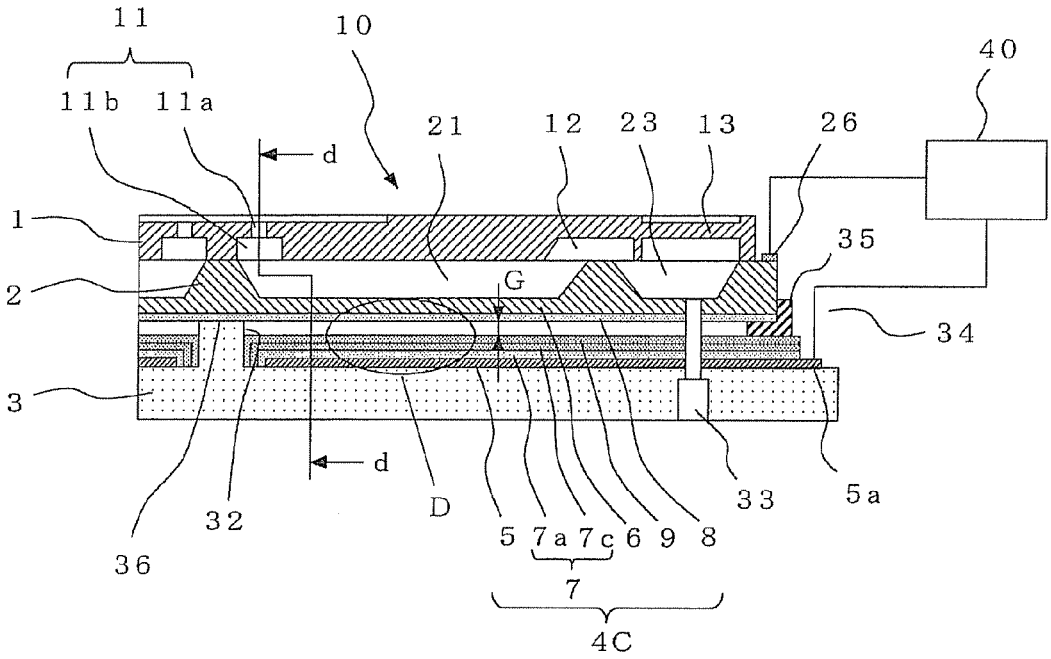
FIG. 12 is a schematic sectional view of an ink-jet head according to a fourth embodiment.
Figure 13:
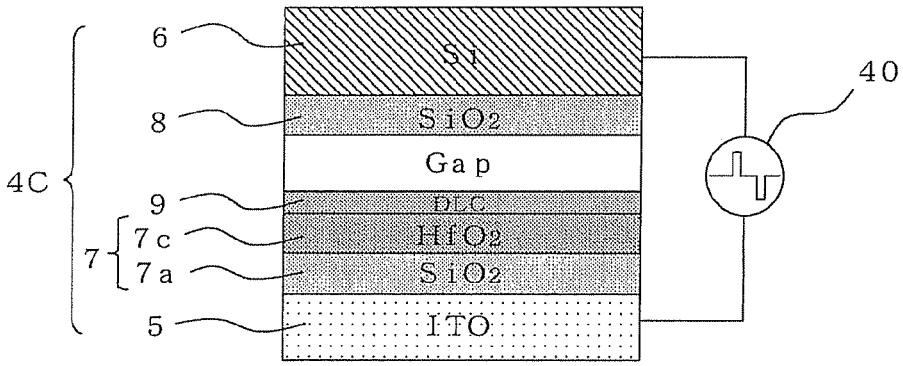
FIG. 13 is an enlarged sectional view of the part "D" shown in FIG. 12.
Figure 14:
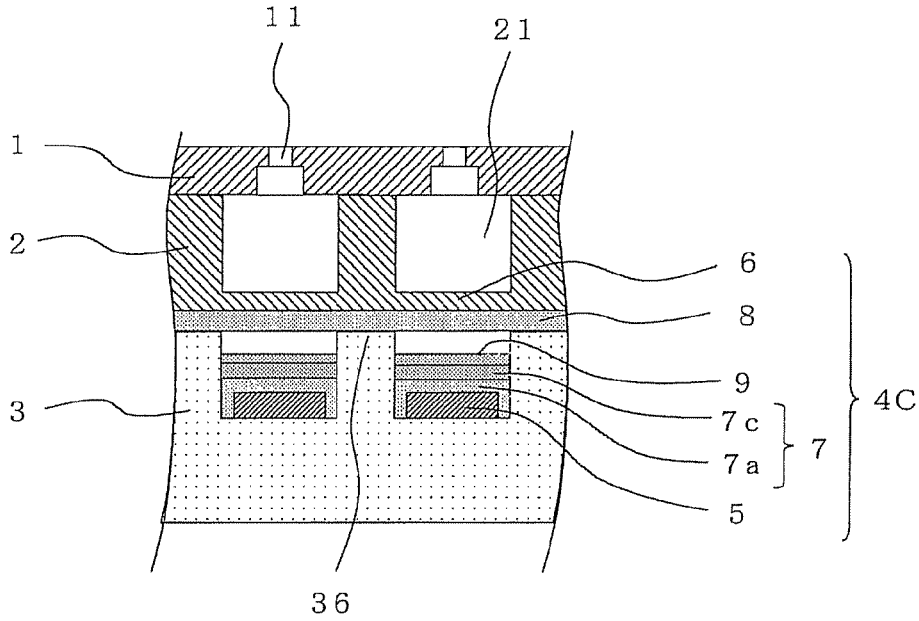
FIG. 14 is an enlarged sectional view along the line d-d in FIG. 12.

FIG. 12 is a schematic sectional view of an ink-jet head 10 according to a fourth embodiment. FIG. 13 is an enlarged sectional view of the part "D" shown in FIG. 12. FIG. 14 is an enlarged sectional view along the line d-d in FIG. 12.

In an electrostatic actuator 4C according to the fourth embodiment, the first insulating film 7 of the individual electrode 5 side has the layered structure of the silicon oxide film 7*a* and the hafnium oxide film 7*c* which is formed on top of the silicon oxide film 7*a*. The surface protection film 9 made of the DLC is provided on top of the hafnium oxide film 7*c*. The second insulating film 8 provided on the vibration plate 6 side is made of the thermally oxidized silicon film. Alternatively the DLC film can be formed on the thermally oxidized silicon film.

As for the thickness of each film, the silicon oxide film 7*a* of the first insulating film 7 is 40 nm, the hafnium oxide film 7*c* of the first insulating film 7 is 40 nm, the thermally oxidized silicon film of the second insulating film 8 is 50 nm, and the DLC film of the surface protection film 9 is 5 nm. The gap G is 200 nm and the thickness of the individual electrode 5 is 100 nm.

The calculated values of the parameter (the ratio of the relative permittivity to the thickness of the insulating film) that relates to the improvement of the pressure generated in the electrostatic actuator according to the fourth embodiment are shown in the hereunder table 5. The suffix "1" of t,∈ denotes the silicon oxide, the suffix "2" denotes the hafnium oxide and "3" denotes the DLC in the table 4. The typical insulating film is the same insulating film in the table 2.

TABLE 5

| | Typical insulating film ($SiO_2$: 110 nm) | Fourth embodiment ($SiO_2$: 90 nm, $HfO_2$: 40 nm, DLC: 5 nm) |
|---|---|---|
| $t/\epsilon$ $(t_1/\epsilon_1 + t_2/\epsilon_2 + t_3/\epsilon_3)$ | 28.95 | 27.15 |

According to the fourth embodiment, the hafnium oxide which has the high relative permittivity is used like the second embodiment. Thereby it is possible to increase the pressure generated in the electrostatic actuator compared with the first embodiment. Moreover the thermally oxidized silicon film that has the fine dielectric strength voltage is formed with a sufficient thickness on the vibration plate side. Therefore the dielectric strength voltage can be increased. The same advantageous effects as the first embodiment concerning the joint strength, the driving endurance and the leak current can also be obtained in the fourth embodiment.

Fifth Embodiment

Figure 15:
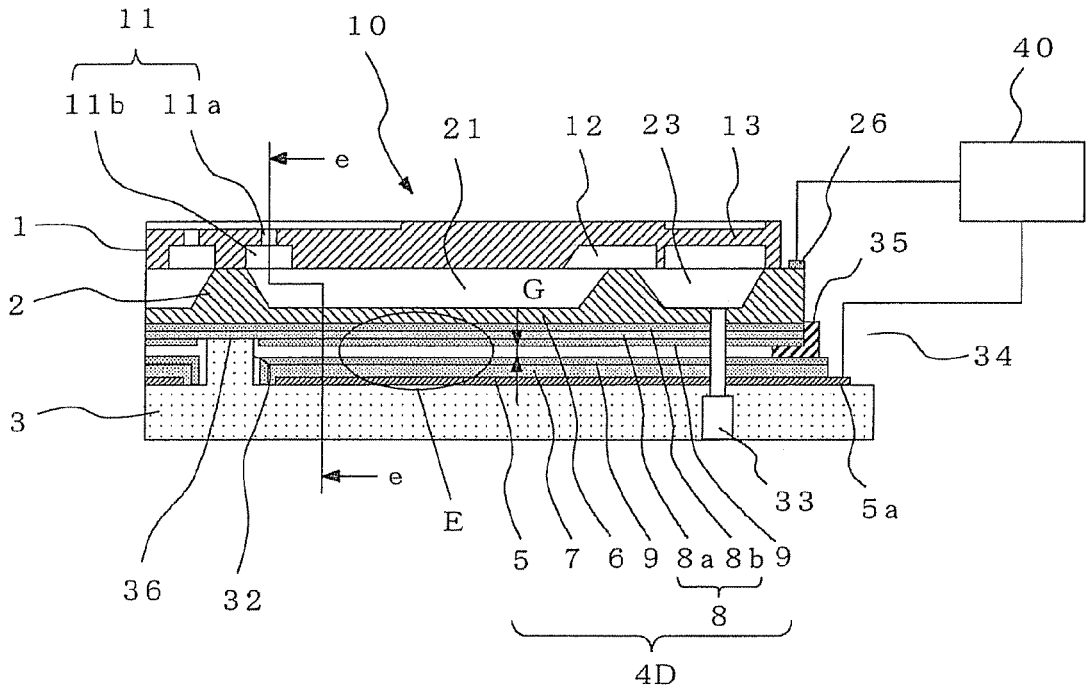
FIG. 15 is a schematic sectional view of an ink-jet head according to a fifth embodiment.
Figure 16:
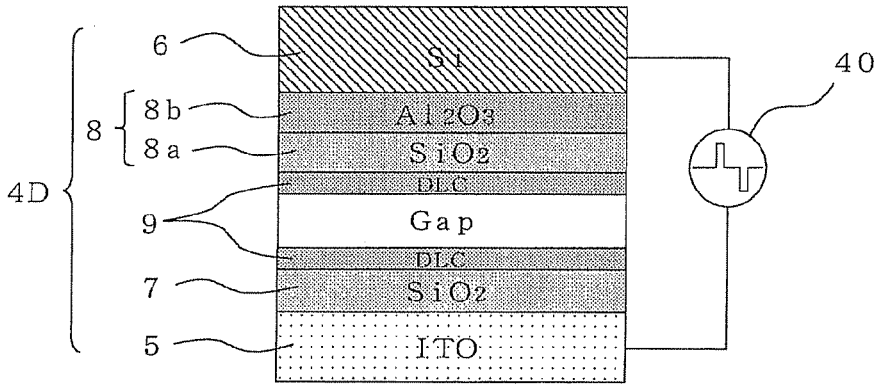
FIG. 16 is an enlarged sectional view of the part "E" shown in FIG. 15.
Figure 17:
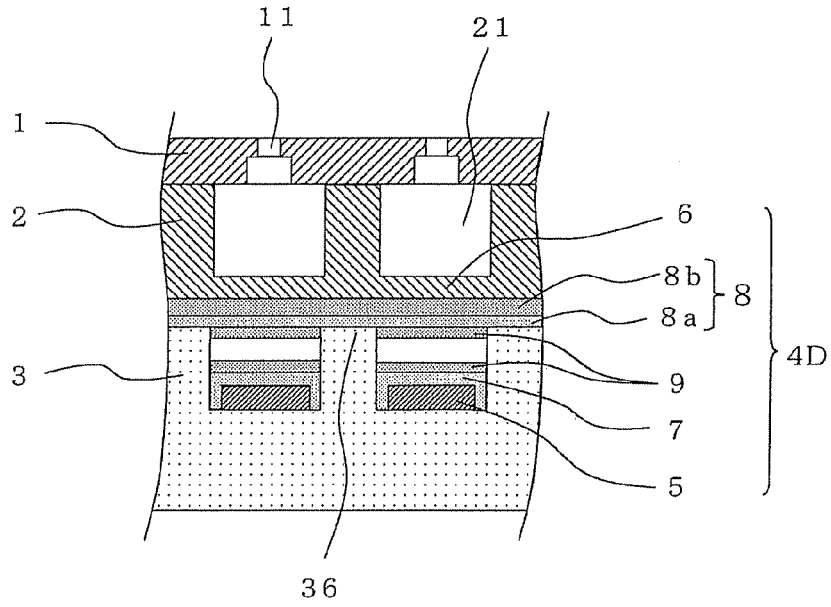
FIG. 17 is an enlarged sectional view along the line e-e in FIG. 15.

FIG. 15 is a schematic sectional view of an ink-jet head 10 according to a fifth embodiment. FIG. 16 is an enlarged sectional view of the part "E" shown in FIG. 15. FIG. 17 is an enlarged sectional view along the line e-e in FIG. 15.

In an electrostatic actuator 4D according to the fifth embodiment, the second insulating film 8 provided on the vibration plate 6 side has the layered structure of the alumina film 8*b* and the silicon oxide film 8*a*. The first insulating film 7 provided on the individual electrode 5 side is made of the silicon oxide film. The surface protection film 9 made of the DLC is provided on both of the first insulating film 7 and the second insulating film 8.

As for the thickness of each film, the silicon oxide film of the first insulating film 7 is 40 nm, the alumina film 8*b* of the second insulating film 8 is 50 nm, the silicon oxide film 8*a* of the second insulating film 8 is 30 nm, and the DLC film of the surface protection film 9 is 5 nm each. The gap G is 200 nm and the thickness of the individual electrode 5 is 100 nm.

The calculated values of the parameter (the ratio of the relative permittivity to the thickness of the insulating film) that relates to the improvement of the pressure generated in the electrostatic actuator according to the fifth embodiment are shown in the hereunder table 6. The suffix "1" of t,∈ denotes the silicon oxide, the suffix "2" denotes the alumina and "3" denotes the DLC in the table 6. The typical insulating film is the same insulating film in the table 2.

TABLE 6

| | Typical insulating film ($SiO_2$: 110 nm) | Fifth embodiment ($SiO_2$: 70 nm, $Al_2O_3$: 50 nm, DLC: 10 nm) |
|---|---|---|
| $t/\epsilon$ $(t_1/\epsilon_1 + t_2/\epsilon_2 + t_3/\epsilon_3)$ | 28.95 | 27.33 |

The surface protection film 9 made of the DLC is formed on the both surface of the first insulating film 7 and the second insulating film 8 according to the fifth embodiment thereby it is possible to make the amount of the electric charge caused by the contact electrification of the driving actuator as small as possible. Consequently the driving endurance is significantly improved. The same advantageous effects as the first embodiment concerning the dielectric strength voltage, the joint strength and the leak current can also be obtained in the fifth embodiment.

Sixth Embodiment

Figure 18:
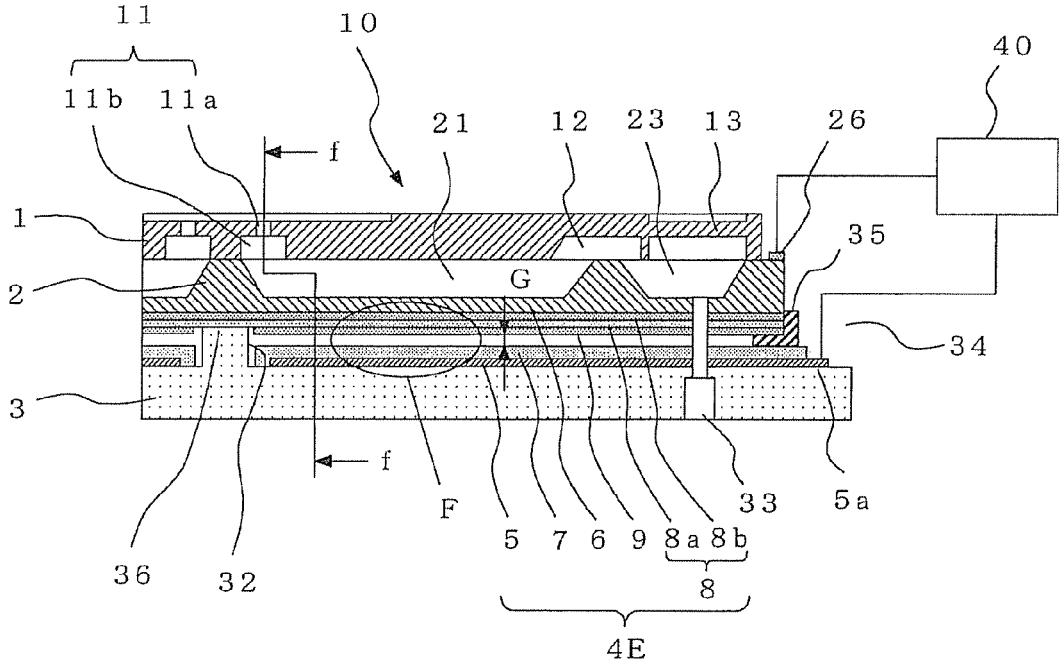
FIG. 18 is a schematic sectional view of an ink-jet head according to a sixth embodiment.
Figure 19:
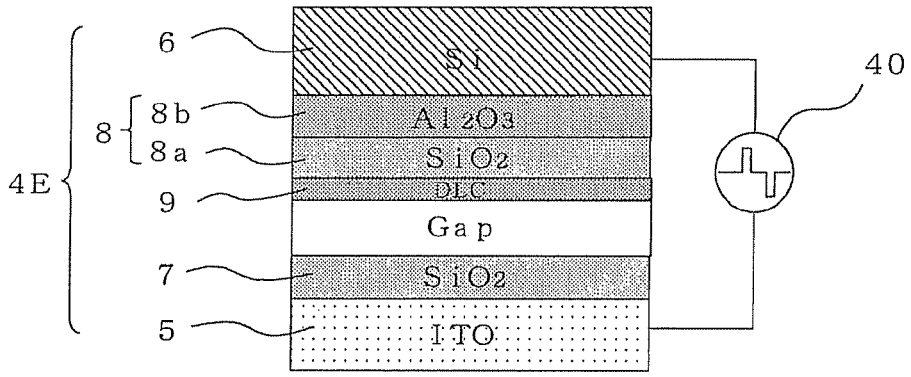
FIG. 19 is an enlarged sectional view of the part "F" shown in FIG. 18.
Figure 20:
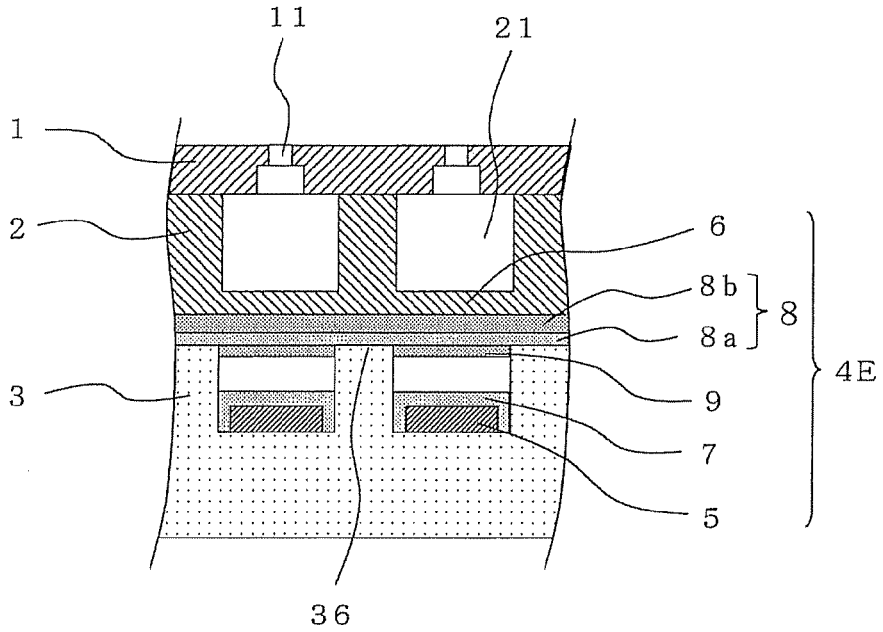
FIG. 20 is an enlarged sectional view along the line f-f in FIG. 18.

FIG. 18 is a schematic sectional view of an ink-jet head 10 according to a sixth embodiment. FIG. 19 is an enlarged sectional view of the part "F" shown in FIG. 18. FIG. 20 is an enlarged sectional view along the line f-f in FIG. 18.

In an electrostatic actuator 4E according to the sixth embodiment, the surface protection film 9 made of the DLC is provided on the second insulating film 8 of the vibration plate 6 side, this is the opposite side to the first embodiment. The structure of the first insulating film 7 and the second insulating film 8 are same as those of the first embodiment.

As for the thickness of each film, the silicon oxide film of the first insulating film 7 is 40 nm, the alumina film 8*b* of the second insulating film 8 is 40 nm, the silicon oxide film 8*a* of the second insulating film 8 is 40 nm, and the DLC film of the surface protection film 9 is 5 nm. The gap G is 200 nm and the thickness of the individual electrode 5 is 100 nm.

The calculated values of the parameter (the ratio of the relative permittivity to the thickness of the insulating film) that relates to the improvement of the pressure generated in the electrostatic actuator according to the sixth embodiment are shown in the hereunder table 7. The suffix "1" of t∈ denotes the silicon oxide, the suffix "2" denotes the alumina and "3" denotes the DLC in the table 7. The typical insulating film is the same insulating film in the table 2.

TABLE 7

| | Typical insulating film ($SiO_2$: 110 nm) | Sixth embodiment ($SiO_2$: 80 nm, $Al_2O_3$: 40 nm, DLC: 5 nm) |
|---|---|---|
| $t/\epsilon$ $(t_1/\epsilon_1 + t_2/\epsilon_2 + t_3/\epsilon_3)$ | 28.95 | 27.43 |

The same advantageous effects as the first embodiment can be obtained in the sixth embodiment. The advantage of providing the DLC on the vibration plate side is that the silicon can form a flat and even film throughout the glass plane thereby the variation in the characteristic of the actuators in the wafer can be reduced. Where the vibration plate is made thin in order to reduce the value of the contact voltage and the DLC film which has a large stress is provided on the vibration plate, the restoring force which is required for the disengagement of the vibration plate can be easily obtained thereby the actuator can be driven with a low voltage.

Though only one of the first insulating film 7 or the second insulating film 8 has the layered structure of the silicon oxide and the High-k material in the above-described sixth embodiment, both of the first insulating film 7 and the second insulating film 8 can be made of the layered structure.

Seventh Embodiment

Figure 21:
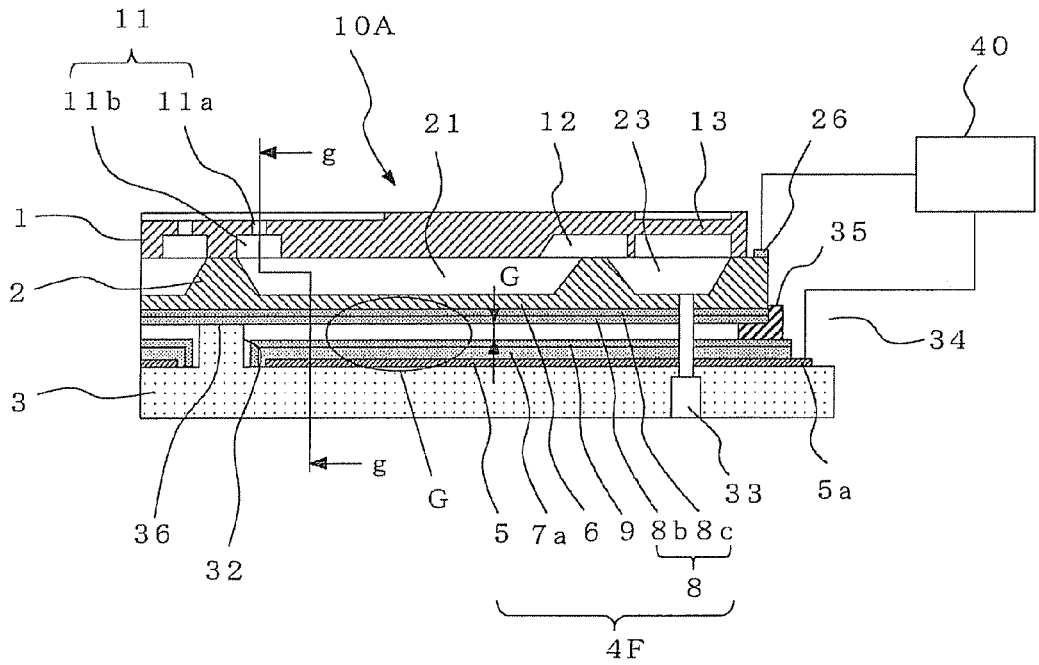
FIG. 21 is a schematic sectional view of an ink-jet head according to a seventh embodiment.
Figure 22:
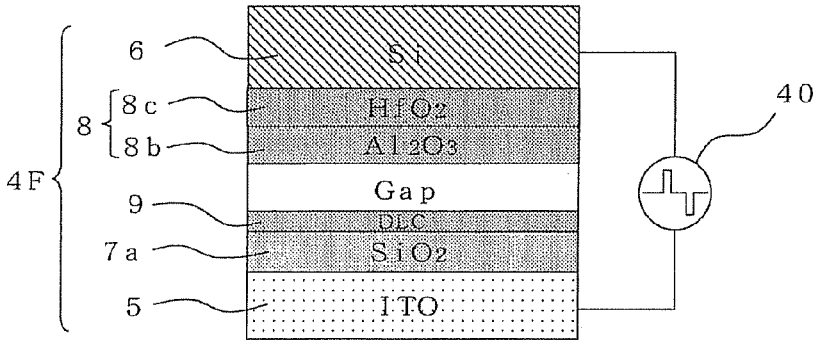
FIG. 22 is an enlarged sectional view of the part "G" shown in FIG. 21.
Figure 23:
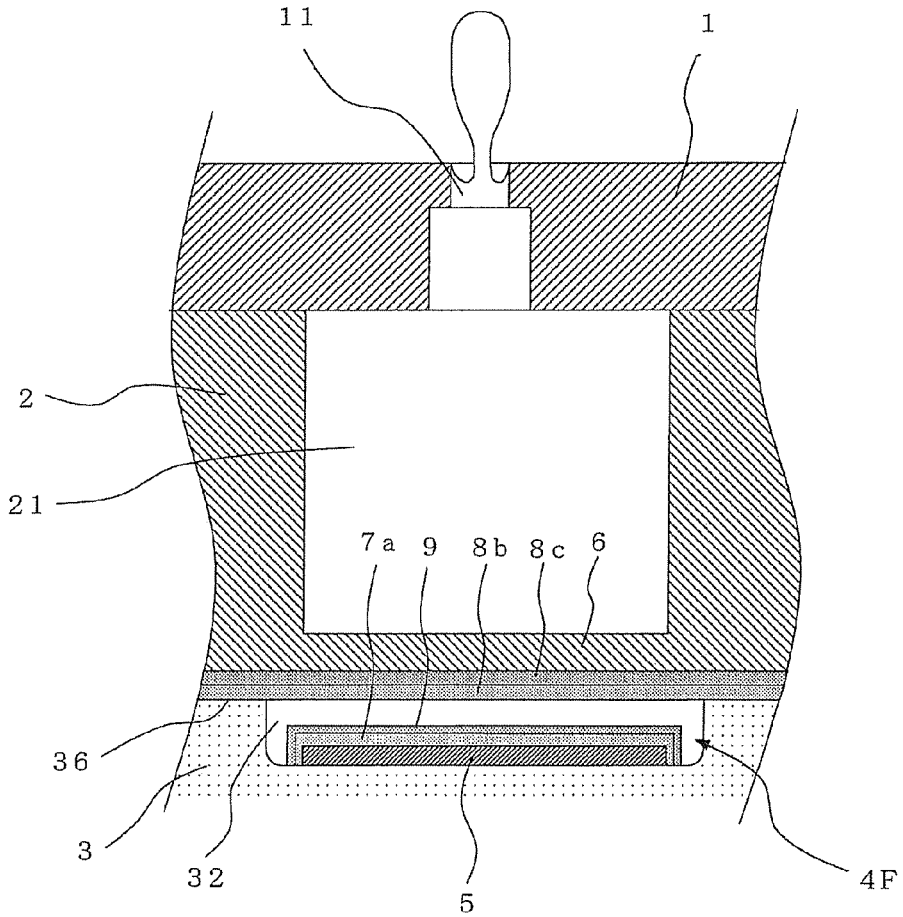
FIG. 23 is an enlarged sectional view along the line g-g in FIG. 21.

FIG. 21 is a schematic sectional view of an ink-jet head 10 according to a seventh embodiment. FIG. 22 is an enlarged sectional view of the part "G" shown in FIG. 21. FIG. 23 is an enlarged sectional view along the line g-g in FIG. 21.

In an electrostatic actuator 4F according to the seventh embodiment, the first insulating film 7 on the individual electrode 5 side has a monolayer structure of the silicon oxide film 7*a*, but the second insulating film 8 on the vibration plate 6 side has the double-layered structure of the hafnium oxide film 8*c* and the alumina film 8*b* which is formed on top of the hafnium oxide film 8*c*. The surface protection film 9 made of the DLC is provided on the surface of the silicon oxide film 7*a*.

As for the thickness of each film, the silicon oxide film 7*a* of the first insulating film 7 is 70 nm, the hafnium oxide film 8*c* of the second insulating film 8 is 20 nm, the alumina film 8*b* of the second insulating film 8 is 40 nm, and the DLC film of the surface protection film 9 is 5 nm. The gap G is 200 nm and the thickness of the individual electrode 5 made of the ITO is 100 nm.

The pressure generated in the electrostatic actuator is now further explained. Where insulating films made of different materials, for example the silicon oxide, the alumina and the hafnium oxide, are provided, the average pressure Pe in the electrostatic actuator is given by the following formula 4.

$$P_e = \frac{\varepsilon_0 V^2}{2\left(\frac{t_1}{\varepsilon_1} + \frac{t_2}{\varepsilon_2} + \frac{t_3}{\varepsilon_3}\right)\left(d + \frac{t_1}{\varepsilon_1} + \frac{t_2}{\varepsilon_2} + \frac{t_3}{\varepsilon_3}\right)} \quad \text{Formula 4}$$

where $t_1$ is the film thickness of the silicon oxide, $t_2$ is the film thickness of the alumina, $t_3$ is the film thickness of the hafnium oxide, $\in_1$ is the relative permittivity of the silicon oxide, $\in_2$ is the relative permittivity of the alumina and $\in_3$ is the relative permittivity of the hafnium oxide. The formula 4 can be derived from the formula 2. In case of the surface protection film 9 of the DLC, the average pressure Pe is given by the following formula, $$P_e = \frac{\varepsilon_0 V^2}{2\left(\frac{t_1}{\varepsilon_1} + \frac{t_2}{\varepsilon_2} + \frac{t_3}{\varepsilon_3} + \frac{t_4}{\varepsilon_4}\right)\left(d + \frac{t_1}{\varepsilon_1} + \frac{t_2}{\varepsilon_2} + \frac{t_3}{\varepsilon_3} + \frac{t_4}{\varepsilon_4}\right)} \quad \text{Formula 4A}$$

where $t_4$ is the film thickness of the DLC and $\in_4$ is the relative permittivity of the DLC.

It can be understood from the formulas 2, 4 and 4A that the parameter that relates to the improvement of the pressure generated in the electrostatic actuator is the ratio of the relative permittivity to the thickness of the insulating film (t/∈). Where the insulating film is made of three different materials like the one described in the seventh embodiment, the parameter is the sum of each film's ratio of the relative permittivity to the thickness ($t_1/\in_1+t_2/\in_2+t_3/\in_3$). The calculated values of the parameter are shown in the following table.

TABLE 8

| | Typical insulating film ($SiO_2$: 110 nm) | Seventh embodiment ($SiO_2$: 70 nm, $Al_2O_3$: 40 nm, $HfO_2$: 20 nm, DLC: 5 nm) |
|---|---|---|
| $t/\epsilon$ $(t_1/\epsilon_1 + t_2/\epsilon_2 + t_3/\epsilon_3 + t_4/\epsilon_4)$ | 28.95 | 25.91 |

The table 8 shows the calculated values of the parameter in cases of the typical insulating film and the seventh example. The suffix "1" of t,∈ denotes the silicon oxide, the suffix "2" denotes the alumina, "3" denotes the hafnium oxide and "4" denotes the DLC. The typical insulating film here is the insulating film that is made of only silicon oxide and has a thickness of 110 nm. As for the thickness of each insulating film described in the seventh embodiment, the silicon oxide film 7*a* of the first insulating film is 70 nm, the hafnium oxide film 8*c* of the second insulating film 8 is 20 nm, the alumina film 8*b* of the second insulating film 8 is 40 nm, and the DLC film of the surface protection film 9 is 5 nm.

In the electrostatic actuator according to the seventh embodiment, the second insulating film 8 on the side of the vibration plate 6 has the double layered insulating structure of the alumina and the hafnium oxide both of which are the High-k material as described above. Thereby the electrostatic actuator has the following advantageous effects compared to the typical electrostatic actuator in which the insulating film is made of only the silicon oxide.

1. The pressure generated in the actuator is increased.
The value of t/∈ can be made smaller as shown in the table 8 with the alumina film and the hafnium oxide both of which are the High-k material, thereby the pressure generated in the actuator is increased.

2. The sufficient dielectric strength voltage is secured.
The silicon oxide film that has the fine dielectric strength voltage is formed with a sufficient thickness so that it is possible to secure the required dielectric strength voltage.

3. The enough joint strength is secured.
The alumina film whose joint strength is larger than that of the hafnium oxide is formed on the joint face side so that it is possible to secure at least the required joint strength.

4. The driving endurance is improved.
The DLC film is formed as the surface protection film on the silicon oxide film of the first insulating film thereby it is possible to significantly improve the driving endurance of the electrostatic actuator.

Eighth Embodiment

Figure 24:
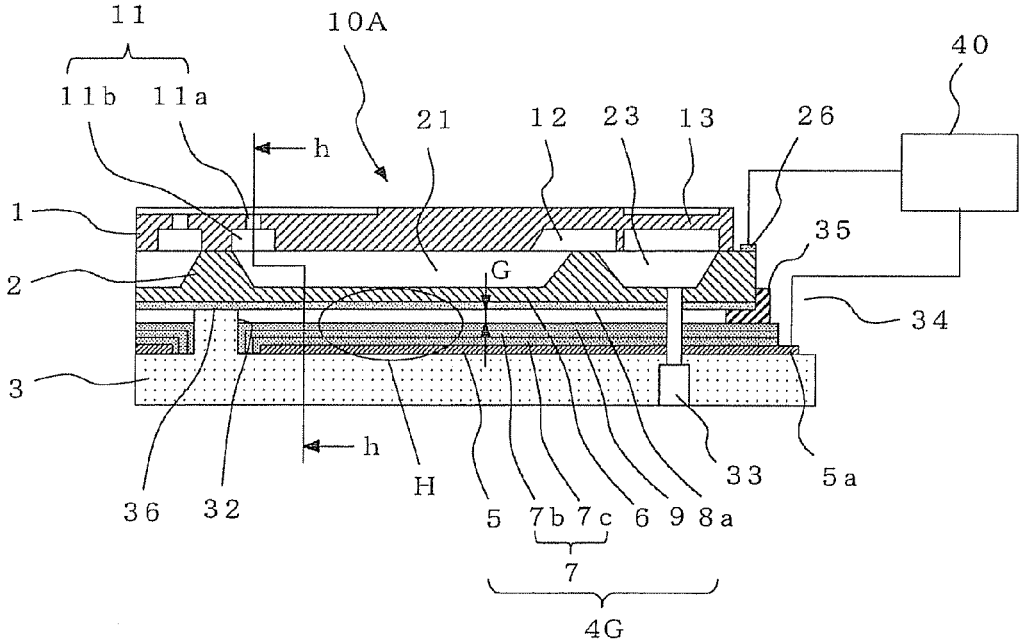
FIG. 24 is a schematic sectional view of an ink-jet head according to an eighth embodiment.
Figure 25:
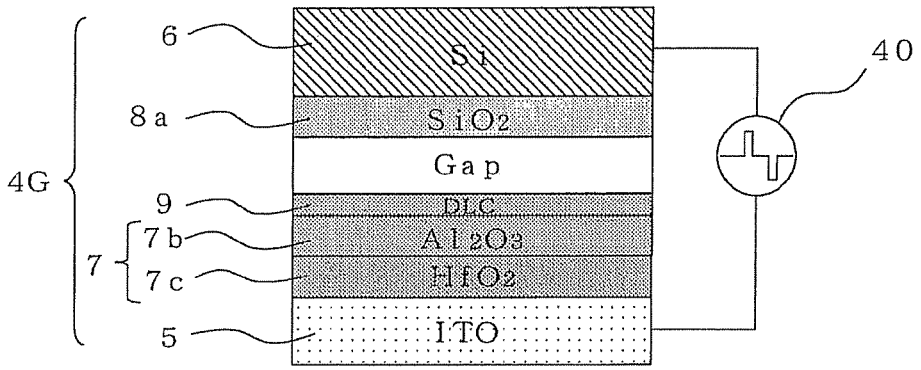
FIG. 25 is an enlarged sectional view of the part "H" shown in FIG. 24.
Figure 26:
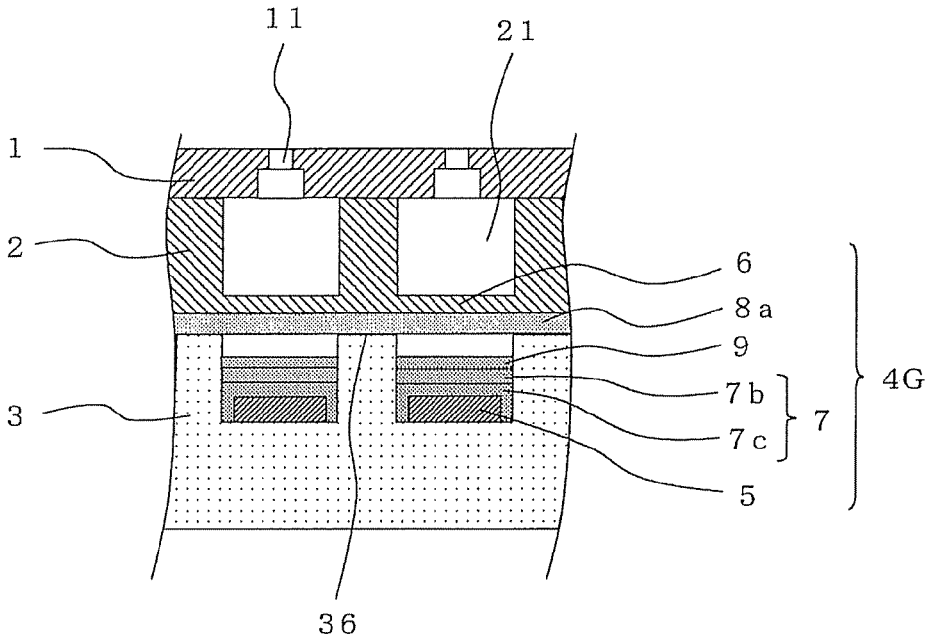
FIG. 26 is an enlarged sectional view along the line h-h in FIG. 24.

FIG. 24 is a schematic sectional view of an ink-jet head 10A according to an eighth embodiment. FIG. 25 is an enlarged sectional view of the part "H" shown in FIG. 24. FIG. 26 is an enlarged sectional view along the line h-h in FIG. 24.

In an electrostatic actuator 4F according to the seventh embodiment, the insulating films have the reversed structure compared to those of the seventh embodiment. The first insulating film 7 on the individual electrode 5 side has the double layered structure of the hafnium oxide 7*c* and the alumina film 7*b* which is provided on top of the hafnium oxide 7*c*. Both the hafnium oxide and the alumina are the High-k material. The second insulating film 8 on the vibration plate 6 side is made of the thermally oxidized silicon film 8*a*. The surface protection film 9 made of the DLC is provided on the surface of the alumina film 7*b*.

As for the thickness of each film, the hafnium oxide 7*c* of the first insulating film 7 is 20 nm, the alumina film 7*b* of the first insulating film 7 is 40 nm, the thermally oxidized silicon film 8*a* of the second insulating film 8 is 70 nm, and the DLC film of the surface protection film 9 is 5 nm. The gap G is 200 nm and the thickness of the individual electrode 5 is 100 nm.

The calculated values of the parameter (the ratio of the relative permittivity to the thickness of the insulating film) that relates to the improvement of the pressure generated in the electrostatic actuator according to the eighth embodiment are shown in the hereunder table 9. The suffix "1" of t,∈ denotes the silicon oxide, the suffix "2" denotes the alumina, "3" denotes the hafnium oxide and "4" denotes the DLC in the table 9. The typical insulating film is the same insulating film in the table 2.

TABLE 9

| | Typical insulating film ($SiO_2$: 110 nm) | Eighth embodiment ($SiO_2$: 70 nm, $Al_2O_3$: 40 nm, $HfO_2$: 20 nm, DLC: 5 nm) |
|---|---|---|
| $t/\epsilon$ $(t_1/\epsilon_1 + t_2/\epsilon_2 + t_3/\epsilon_3 + t_4/\epsilon_4)$ | 28.95 | 25.91 |

According to the eighth embodiment, the insulating structure is reversed to that of the seventh embodiment. The thermally oxidized silicon film 8*a* that has a fine dielectric strength voltage is formed with a sufficient thickness as the second insulating film 8 in the vibration plate 6 side so that the eighth embodiment has a higher dielectric strength voltage than the seventh embodiment.

The same advantageous effects as the seventh embodiment concerning the pressure generated by the actuator and the driving endurance can be obtained in the eighth embodiment. As for the joint strength, the joint is conducted between the silicon oxides thereby the eighth embodiment can secure a higher joint strength than the seventh embodiment.

Moreover, concerning the manufacturing process, it is not necessary to remove the thermally oxidized silicon film 8*a* that is situated in the joint face of the silicon substrate according to the eighth embodiment. In this sense, the manufacturing process is simplified compared to the seven embodiment and the manufacturing cost can be reduced.

Ninth Embodiment

Figure 27:
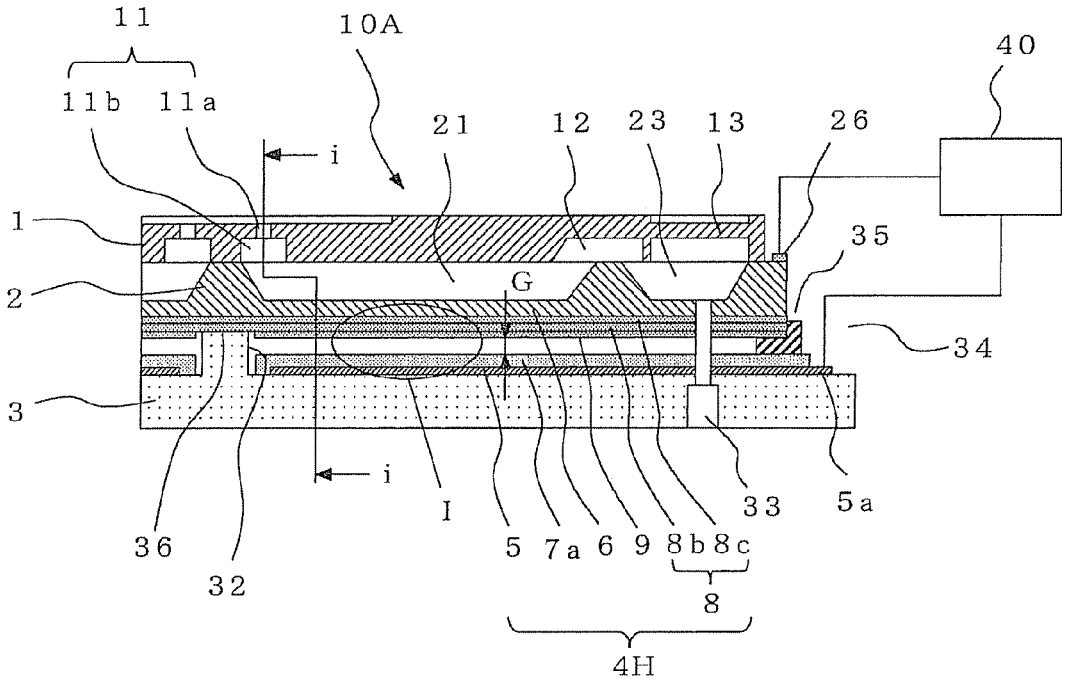
FIG. 27 is a schematic sectional view of an ink-jet head according to a ninth embodiment.
Figure 28:
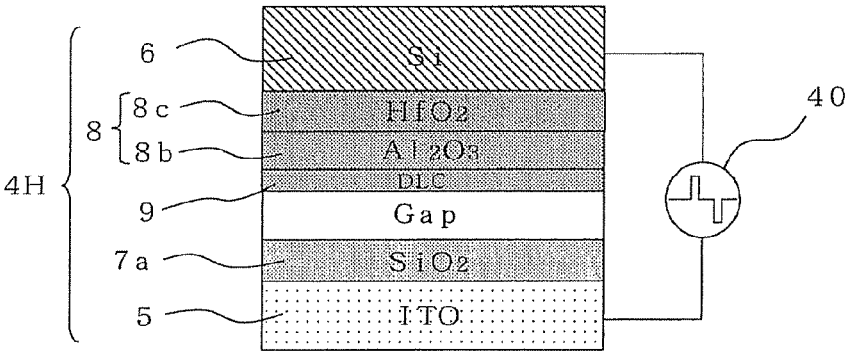
FIG. 28 is an enlarged sectional view of the part "I" shown in FIG. 27.
Figure 29:
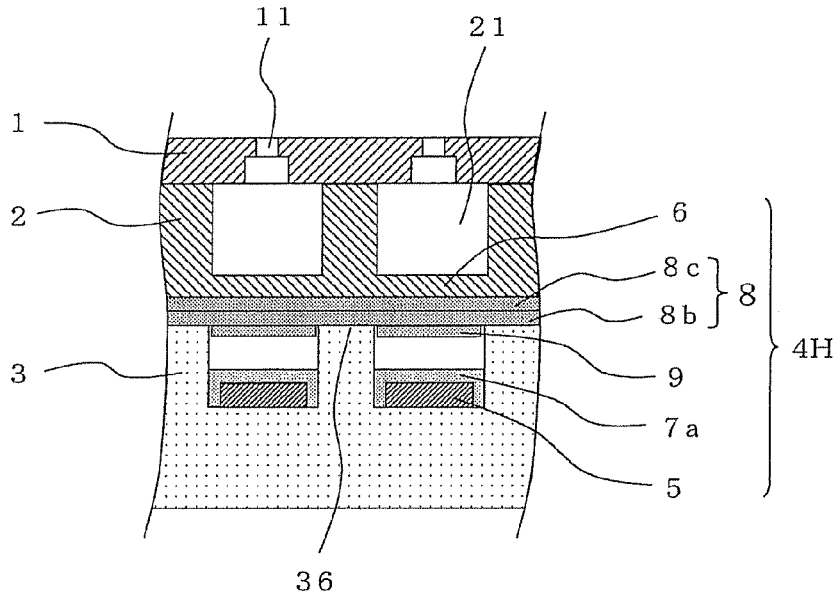
FIG. 29 is an enlarged sectional view along the line i-i in FIG. 27.

FIG. 27 is a schematic sectional view of an ink-jet head 10A according to a ninth embodiment. FIG. 28 is an enlarged sectional view of the part "I" shown in FIG. 27. FIG. 29 is an enlarged sectional view along the line i-i in FIG. 27.

In an electrostatic actuator 4H according to the ninth embodiment, the insulating films have the same structure as those of the seventh embodiment except that the surface protection film 9 made of the DLC is formed on the alumina film 8*b* of the second insulating film 8.

As for the thickness of each film, the silicon oxide film 7*a* of the first insulating film 7 is 70 nm, the hafnium oxide film 8*c* of the second insulating film 8 is 20 nm, the alumina film 8*b* of the second insulating film 8 is 40 nm, and the DLC film of the surface protection film 9 is 5 nm. The gap G is 200 nm and the thickness of the individual electrode 5 is 100 nm.

The calculated values of the parameter (the ratio of the relative permittivity to the thickness of the insulating film) that relates to the improvement of the pressure generated in the electrostatic actuator according to the ninth embodiment are shown in the following table 9. The suffix "1" of t,∈ denotes the silicon oxide, the suffix "2" denotes the alumina, "3" denotes the hafnium oxide and "4" denotes the DLC in the table 10. The typical insulating film is the same insulating film in the table 2.

TABLE 10

| | Typical insulating film ($SiO_2$: 110 nm) | Ninth embodiment ($SiO_2$: 70 nm, $Al_2O_3$: 40 nm, $HfO_2$: 20 nm, DLC: 5 nm) |
|---|---|---|
| $t/\epsilon$ $(t_1/\epsilon_1 + t_2/\epsilon_2 + t_3/\epsilon_3 + t_4/\epsilon_4)$ | 28.95 | 25.91 |

The same advantageous effects as the seventh embodiment can be obtained for the ninth embodiment. The advantage of providing the DLC on the vibration plate side is that the silicon can form a flat and even film throughout on the glass plane thereby the variation in the characteristic of the actuators in the wafer can be reduced. Where the vibration plate is made thin in order to reduce the value of the contact voltage and the DLC film which has a large stress is provided on the vibration plate, the restoring force which is required for the disengagement of the vibration plate can be easily obtained thereby the actuator can be driven with a low voltage.

Tenth Embodiment

Figure 30:
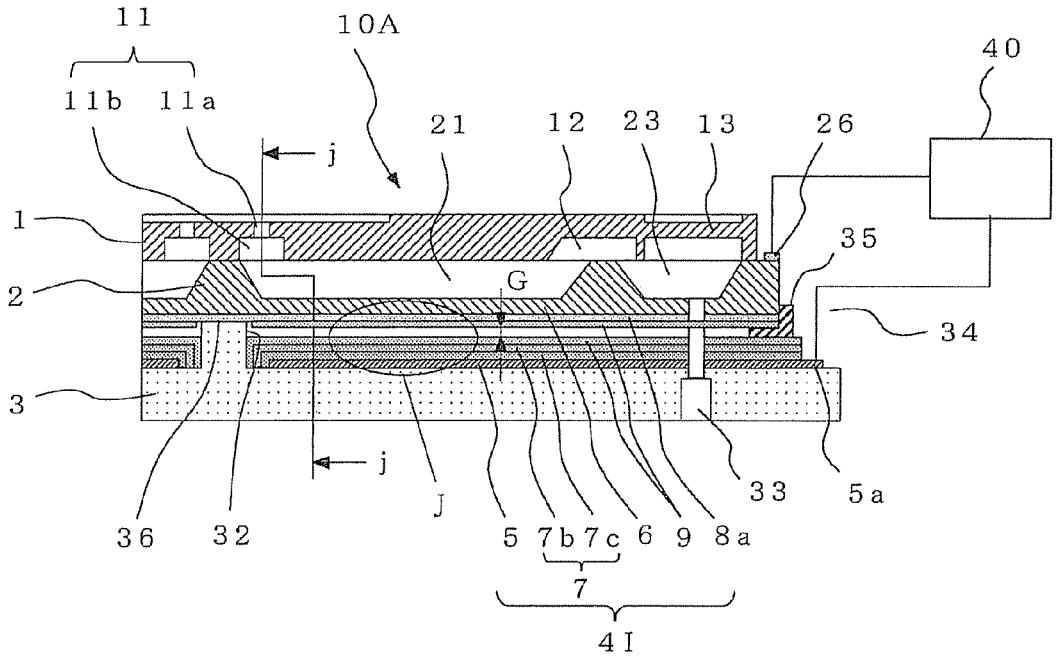
FIG. 30 is a schematic sectional view of an ink-jet head according to a tenth embodiment.
Figure 31:
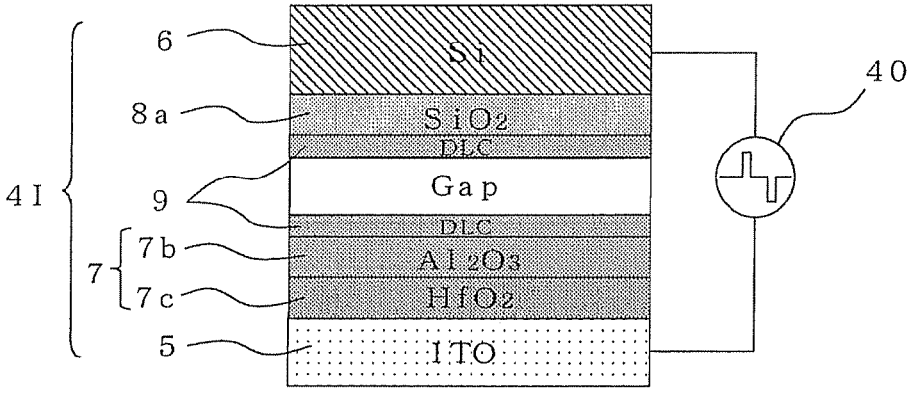
FIG. 31 is an enlarged sectional view of the part "J" shown in FIG. 30.
Figure 32:
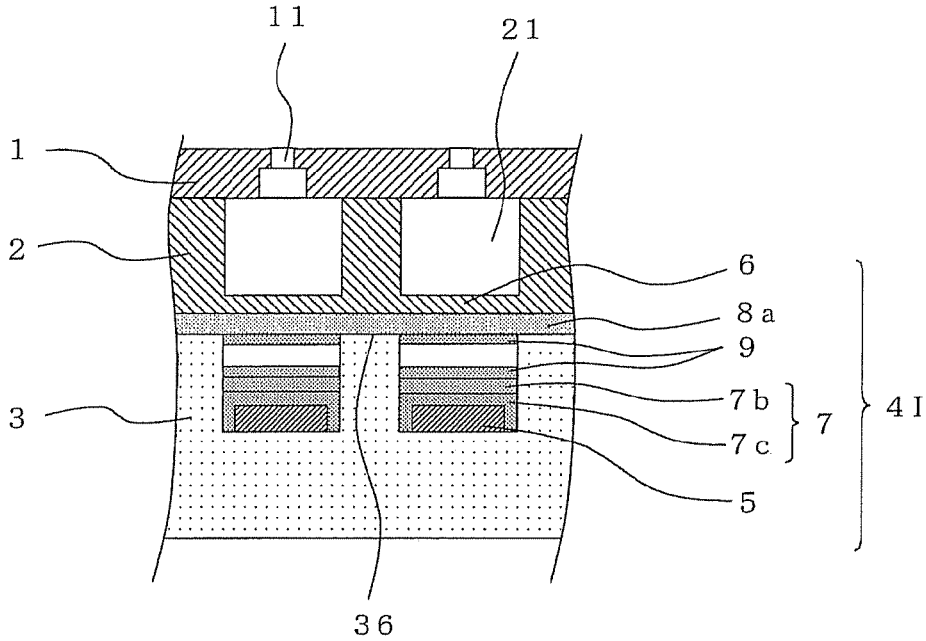
FIG. 32 is an enlarged sectional view along the line j-j in FIG. 30.

FIG. 30 is a schematic sectional view of an ink-jet head 10A according to a tenth embodiment. FIG. 31 is an enlarged sectional view of the part "J" shown in FIG. 30. FIG. 32 is an enlarged sectional view along the line j-j in FIG. 30.

In an electrostatic actuator 4I according to the tenth embodiment, the insulating films have the same structure as those of the eighth embodiment except that the surface protection film 9 made of the DLC is further formed on the thermally oxidized silicon film 8*a* of the second insulating film 8. In other words, the DLC film which is the surface protection film 9 is formed on both of the first insulating film 7 and the second insulating film 8.

As for the thickness of each film, the hafnium oxide 7*c* of the first insulating film 7 is 20 nm, the alumina film 7*b* of the first insulating film 7 is 40 nm, the thermally oxidized silicon film 8*a* of the second insulating film 8 is 70 nm, and the DLC film of the surface protection film 9 is 5 nm each. The gap G is 200 nm and the thickness of the individual electrode 5 is 100 nm.

The calculated values of the parameter (the ratio of the relative permittivity to the thickness of the insulating film) that relates to the improvement of the pressure generated in the electrostatic actuator according to the tenth embodiment are shown in the hereunder table 11. The suffix "1" of t,∈ denotes the silicon oxide, the suffix "2" denotes the alumina, "3" denotes the hafnium oxide and "4" denotes the DLC in the table 10. The typical insulating film is the same insulating film in the table 2.

TABLE 11

| | Typical insulating film ($SiO_2$: 110 nm) | Tenth embodiment ($SiO_2$: 70 nm, $Al_2O_3$: 40 nm, $HfO_2$: 20 nm, DLC: 10 nm) |
|---|---|---|
| $t/\epsilon$ $(t_1/\epsilon_1 + t_2/\epsilon_2 + t_3/\epsilon_3 + t_4/\epsilon_4)$ | 28.95 | 27.16 |

The surface protection film 9 made of the DLC is formed on the both surface of the first insulating film 7 and the second insulating film 8 according to the tenth embodiment thereby it is possible to make the amount of the electric charge caused by the contact electrification of the driving actuator as small as possible. Consequently the driving endurance is significantly improved. The same advantageous effects as the eighth embodiment concerning the dielectric strength voltage and the joint strength can also be obtained in the tenth embodiment.

Eleventh Embodiment

Figure 33:
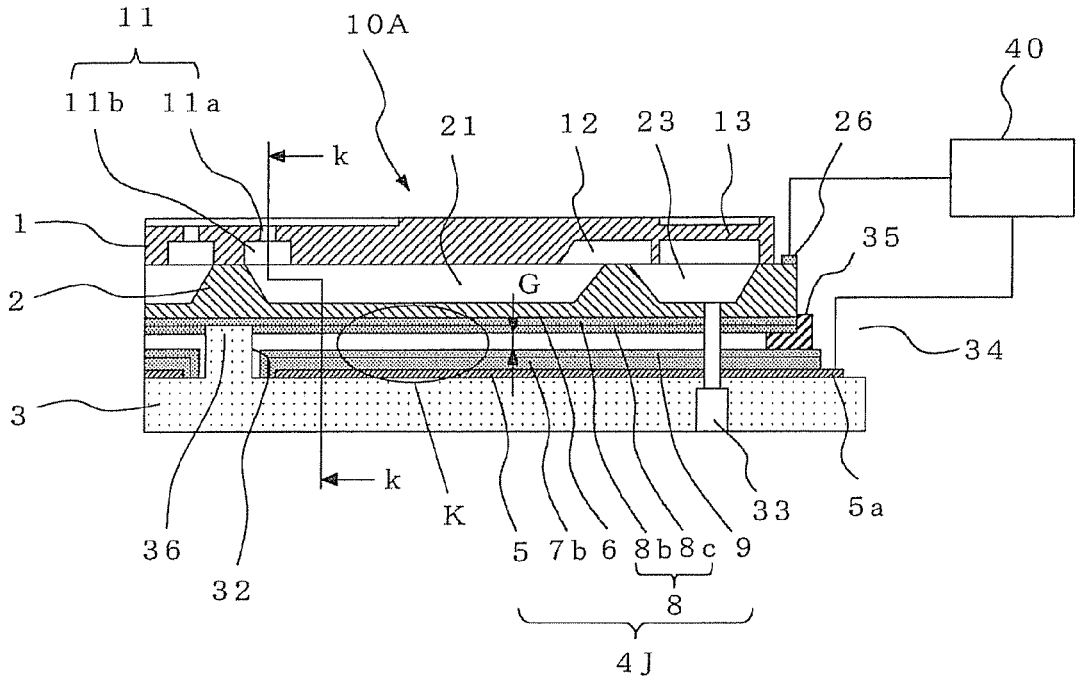
FIG. 33 is a schematic sectional view of an ink-jet head according to an eleventh embodiment.
Figure 34:
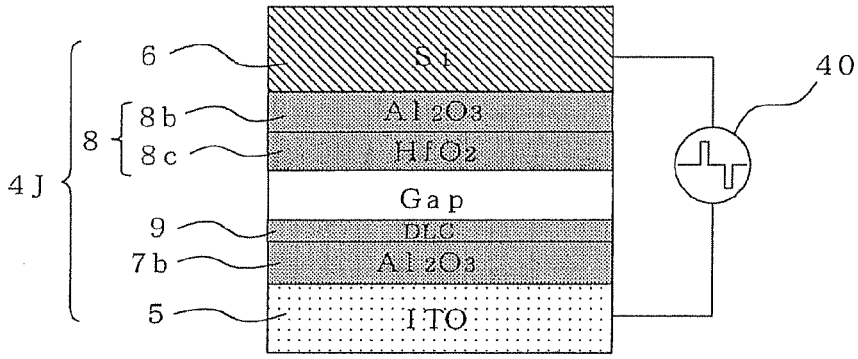
FIG. 34 is an enlarged sectional view of the part "K" shown in FIG. 33.
Figure 35:
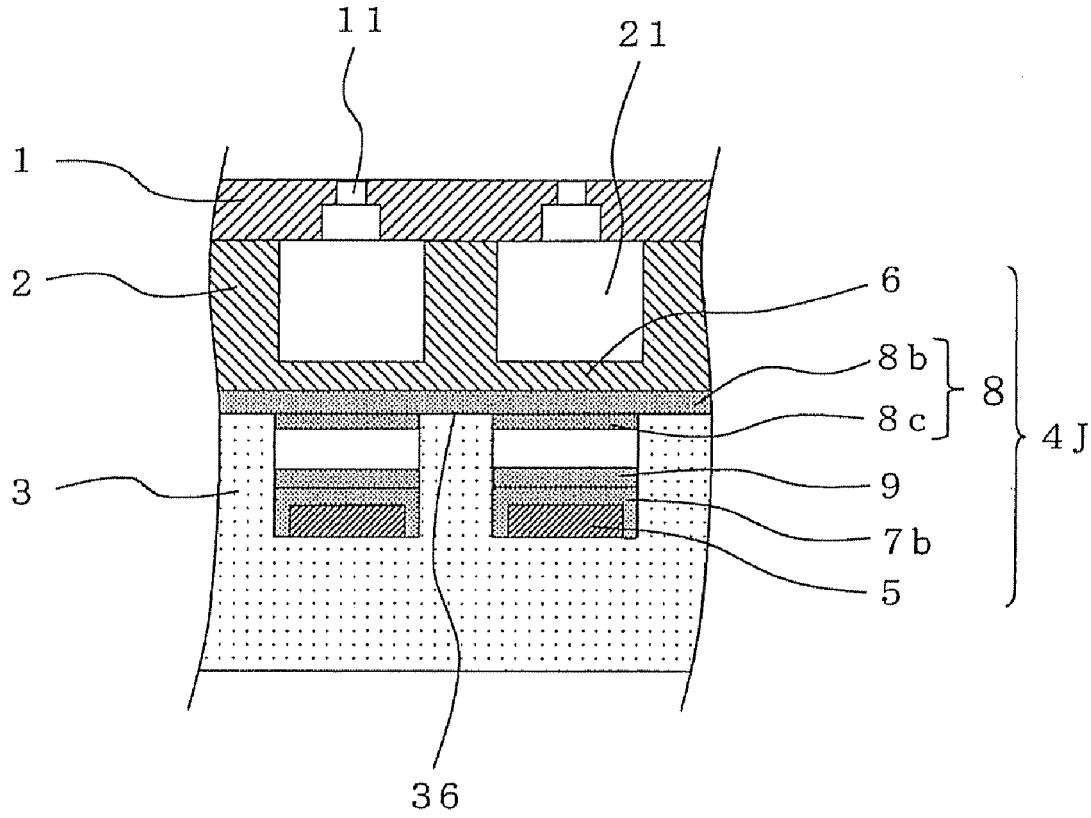
FIG. 35 is an enlarged sectional view along the line k-k in FIG. 33.

FIG. 33 is a schematic sectional view of an ink-jet head 10A according to an eleventh embodiment. FIG. 34 is an enlarged sectional view of the part "K" shown in FIG. 33. FIG. 35 is an enlarged sectional view along the line k-k in FIG. 33.

In an electrostatic actuator 4J according to the eleventh embodiment, the first insulating film 7 on the individual electrode 5 side is made of the alumina film 7*b* and the surface protection film 9 made of the DLC is provided on the alumina film 7*b*. The second insulating film 8 on the vibration plate 6 side has the double layered structure of the alumina film 8*b* and the hafnium oxide film 8*c*. In this case, the hafnium oxide has a low joint strength therefore the hafnium oxide film 8*c* existing in a joint part 36 between the cavity substrate 2 and the electrode substrate 3 is removed and these substrates 2, 3 are jointed together through the alumina film 8*b*. Accordingly, it is possible to secure at least the required joint strength for the actuator in the same way as the seventh embodiment.

As for the thickness of each film, the alumina film 7*b* of the first insulating film 7 is 40 nm, the alumina film 8*b* of the second insulating film 8 is 90 nm, the hafnium oxide film 8*c* of the second insulating film 8 is 20 nm, and the DLC film of the surface protection film 9 is 5 nm. The gap G is 200 nm and the thickness of the individual electrode 5 is 100 nm.

The calculated values of the parameter (the ratio of the relative permittivity to the thickness of the insulating film) that relates to the improvement of the pressure generated in the electrostatic actuator according to the eleventh embodiment are shown in the hereunder table 12. The suffix "1" of t,∈ denotes the alumina, the suffix "2" denotes the hafnium oxide and "3" denotes the DLC in the table 12. The typical insulating film is the same insulating film in the table 2.

TABLE 12

| | Typical insulating film ($SiO_2$: 110 nm) | Eleventh embodiment ($Al_2O_3$: 130 nm, $HfO_2$: 20 nm, DLC: 5 nm) |
|---|---|---|
| $t/\epsilon$ $(t_1/\epsilon_1 + t_2/\epsilon_2 + t_3/\epsilon_3)$ | 28.95 | 19.03 |

As shown in the table 12, the value of t/∈ is smallest according to the eleventh embodiment so that it is possible to improve the pressure generated in the electrostatic actuator more than the first-tenth embodiments.

As for the dielectric strength voltage, the sufficiently thick alumina film 8*b* is provided on the vibration plate side so that the necessary dielectric strength voltage can be secured. The same advantageous effects as the seventh embodiment concerning the joint strength and the driving endurance can be obtained in the eleventh embodiment.

Though only one of the first insulating film 7 or the second insulating film 8 has the layered structure of the High-k material in the above-described seventh-eleventh embodiments, both of the first insulating film 7 and the second insulating film 8 can be made of the layered structure.

Figure 36:
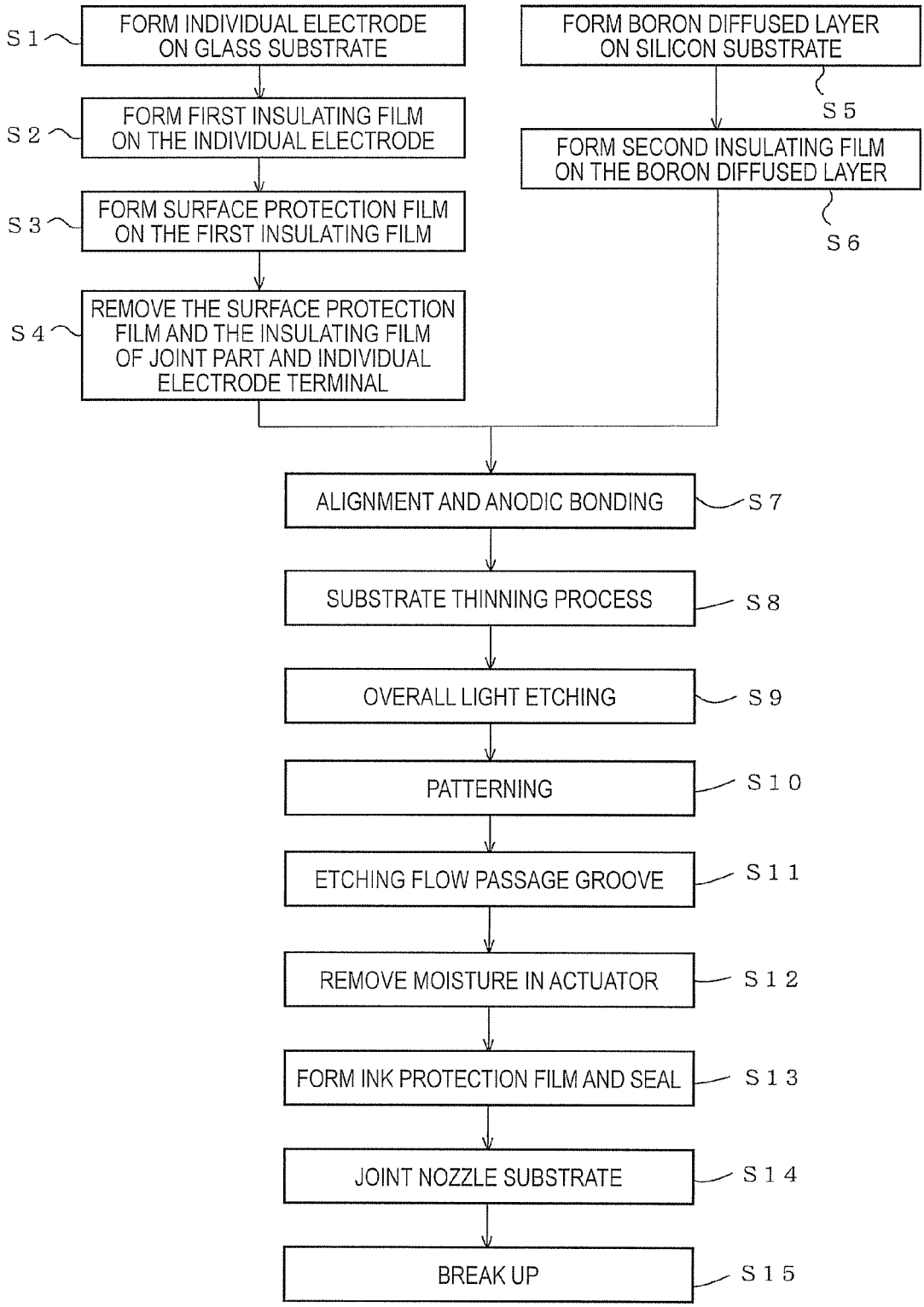
FIG. 36 is a flow chart schematically showing steps in the manufacturing process of the ink-jet head.
Figure 37A:
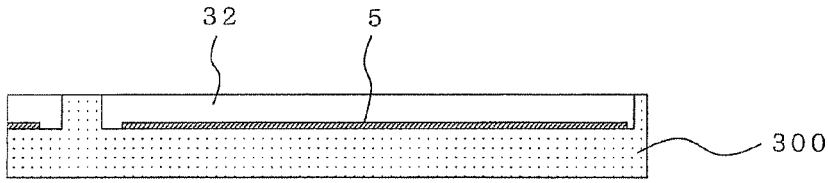
FIGS. 37A-37C are sectional views of the electrode substrate for showing steps in the manufacturing process schematically.
Figure 37B:
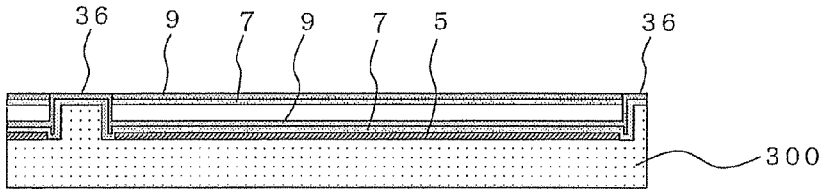
Figure 37C:
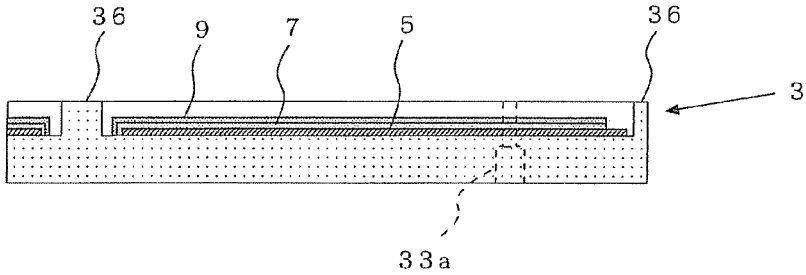

An example of manufacturing method of the ink-jet head 10 according to the first-sixth embodiments is now described with reference to FIGS. 36-38. FIG. 36 is a flow chart schematically showing steps in the manufacturing process of the ink-jet head 10. FIG. 37 is a sectional view of the electrode substrate 3 for showing steps in the manufacturing process schematically. FIG. 38 is a sectional view of the ink-jet head 10 for showing steps in the manufacturing process schematically.

Referring to FIG. 36, the steps S1-S4 are the steps for fabricating the electrode substrate 3, and the steps S5 and S6 are the steps for fabricating the silicon substrate from which the cavity substrate 2 is formed.

Here a method for manufacturing the ink-jet head 10 according to the first embodiment is mainly described and a method for other ink-jet head according to the second-sixth embodiments will be described where necessary.

The electrode substrate 3 is fabricated as follows. A glass substrate 300 that is made of borosilicate or the like and has a thickness of about 1 mm is etched with hydrofluoric acid through for example an etching mask made of gold-chromium or the liked so as to form the concave portion 32 with a predetermined depth. The concave portion 32 is the groove whose size is larger than the shape of the individual electrode 5 and provided with respect to the individual electrode 5. The indium tin oxide (ITO) film is subsequently formed in 100 nm thick by for example sputtering and the ITO film is then patterned by photolithography. The part of the ITO film other than the part where is going to be the individual electrode 5 is removed by etching. In this way, the individual electrode 5 is formed in the concave portion 32 (Step 1 in FIG. 36 and FIG. 37A).

An silicon oxide film ($SiO_2$) having a thickness of 40 nm is formed as the first insulating film 7 of the individual electrode 5 side on the whole joint face of the glass substrate 300 by a RF-chemical vapor deposition (CVD) method using tetra-ethoxy-silane (TEOS) as a material gas (Step 2 in FIG. 36). A DLC film having a predetermined thickness is then formed as the surface protection film 9 on the overall surface of the silicon oxide film by a parallel-plate type RF-CVD method using a toluene gas as a material gas (Step 3 is FIG. 36, FIG. 37B).

The DLC film existing in the position corresponding to the joint part 36 of the glass substrate 300 and the terminal part 5*a* of the individual electrode 5 is removed by patterning and $O_2$ ashing. After the DLC film is removed, the silicon oxide film existing in the same position is removed by dry-etching such as a reactive ion etching (RIE) using $CHF_3$ (Step 4 is FIG. 36, FIG. 37C). Subsequently an opening 33*a* which is going to be the ink feed opening 33 is formed by blast processing or the like.

Through the above-described process, the electrode substrate 3 according to the first embodiment can be fabricated.

The electrode substrate 3 according to the second embodiment can be fabricated in the same way as the above-described first embodiment case.

In the case of the third embodiment, the hafnium oxide film 7*c* is formed in a predetermined thickness as the first insulating film 7 of the individual electrode 5 side on the whole joint face of the glass substrate 300 by an electron cyclotron resonance (ECR) sputtering method. The silicon oxide film 7*a* having a predetermined thickness is then formed so as to cover the hafnium oxide film by the RF-CVD using the TEOS as a material gas. The DLC film having a predetermined thickness is then formed as the surface protection film 9 on the overall surface of the silicon oxide film 7*a* by the parallel-plate type RF-CVD method using the toluene gas as a material gas. The DLC film existing in the position corresponding to the joint part 36 of the glass substrate 300 and the terminal part 5*a* of the individual electrode 5 is removed by patterning and $O_2$ ashing. After the DLC film is removed, the silicon oxide film 7*a* and the hafnium oxide film 7*c* existing in the position are simultaneously removed by dry-etching such as the RIE using $CHF_3$.

In the case of the fourth embodiment, only the film formation order is reversed compared with the third embodiment, in other words the silicon oxide film 7*a* is firstly formed and the hafnium oxide film 7*c* is then formed, and the rest of the process are the same as the third embodiment.

In the case of the fifth embodiment, the process is the same as the case of the first embodiment.

In the case of the sixth embodiment, the process is simplified compared to the first embodiment case such that a silicon oxide film is formed as the first insulating film 7 on the whole joint face of the glass substrate 300 and only the silicon oxide film existing in the position corresponding to the terminal part 5*a* of the individual electrode 5 is removed by the RIE dry-etching using $CHF_3$. In this case, the insulating film situated at the joint part 36 of the glass substrate 300 is not necessarily removed.

The electrode substrate 3 according to the second-sixth embodiments can be formed in the above-described way.

After a silicon substrate 200 is anodically bonded to the electrode substrate 3 which is fabricated through the above-described process, the cavity substrate 2 is fabricated.

The silicon substrate 200 is fabricated by forming a boron diffused layer 201 whose thickness is for example 0.8 μm on one side of the silicon substrate 200 having a thickness of for example 280 μm (Step 5 is FIG. 36).

The alumina film 8*b* having a thickness of 40 nm is formed as the second insulating film 8 on the whole surface (upper face) of the boron diffused layer 201 of the silicon substrate 200 by the ECR sputtering method. Subsequently the silicon oxide film 8*a* having a thickness of 40 nm is formed as the second insulating film 8 on the alumina film 8*b* by the RF-CVD method using TEOS as a material gas (Step 6 is FIG. 36, FIG. 38A).

In the case of the second embodiment, the hafnium oxide film 8*c* is formed instead of the alumina film on the whole surface of the boron diffused layer 201.

In the case of the third and fourth embodiments, the thermally oxidized silicon film is preferably formed on the whole surface of the boron diffused layer 201 by a thermal oxidation method.

In the case of the fifth and sixth embodiments, after the alumina film 8*b* and the silicon oxide film 8*a* are formed in the same manner as the first embodiment, the DLC film is formed as the surface protection film 9 on the whole face of the silicon oxide film 8*a*. The DLC film existing in the position corresponding to the joint part between the silicon substrate 200 and the electrode substrate 3 is removed by patterning and $O_2$ ashing.

Through the above-described process, the silicon substrate 200 according to the second-sixth embodiments can be fabricated.

Figure 38A:
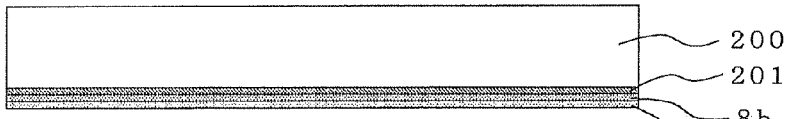
FIGS. 38A-38G are sectional views of the ink-jet head for showing steps in the manufacturing process schematically.
Figure 38B:
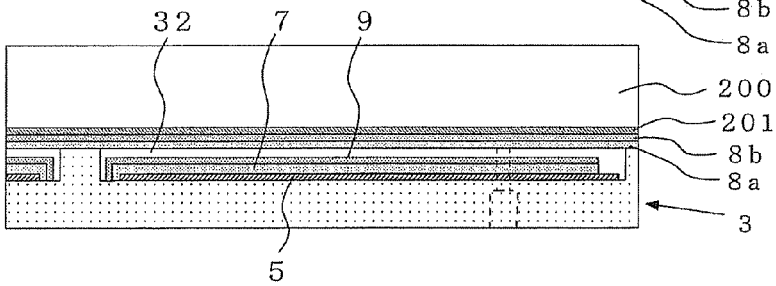

The silicon substrate 200 fabricated in the above-described process is aligned and anodically bonded onto the electrode substrate 3 (Step 7 is FIG. 36, FIG. 38B).

Figure 38C:
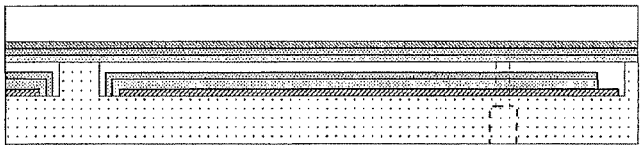

The whole surface of the bonded silicon substrate 200 is then polished for thinning the substrate so as to have a thickness of for example 50 μm (Step 8 is FIG. 36, FIG. 38C). The whole surface of the silicon substrate 200 is further light-etched by wet-etching so as to remove processing marks (Step 9 is FIG. 36).

Figure 38D:
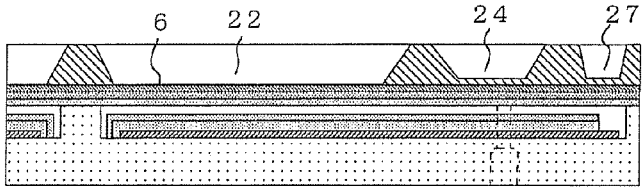
Figure 38E:
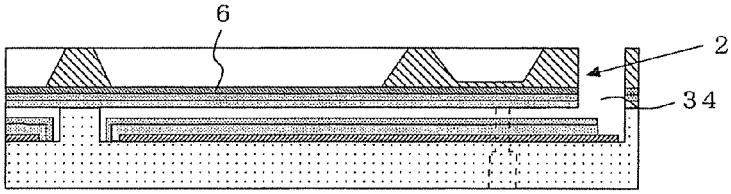
Figure 38F:
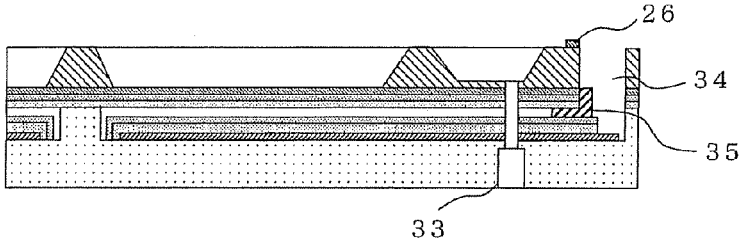

Resist patterning is performed on the surface of the jointed and thinned silicon substrate 200 by photolithography (Step 10 is FIG. 36) and an ink flow passage groove is formed by wet-etching or dry-etching (Step 11 is FIG. 36). Through this step, the concave portion 22 which is going to be the discharge chamber 21, the concave portion 24 which is going to be the reservoir 23 and the concave portion 27 which is going to be the electrode exposed part 34 (FIG. 38D). At this point, the etching will be stopped at the surface of the boron diffused layer 201 therefore the vibration plate 6 can be formed with a precise thickness and it is possible to avoid causing the roughness in the surface.

The bottom part of the concave portion 27 is removed by inductively coupled plasma (ICP) dry-etching so as to open the electrode exposed part 34 (FIG. 38E), the moisture staying in the electrostatic actuator is then removed (Step 12 is FIG. 36). The removal can be performed for example by putting the silicon substrate into a vacuum chamber and exposing the substrate to nitrogen atmosphere. After a predetermined time passed, the sealant material 35 such as an epoxy resin or the like is applied to the gap opening end part under the nitrogen atmosphere and the actuator is air-tightly sealed (Step 13 is FIG. 36, FIG. 38F). Since the electrostatic actuator is air-tightly sealed after the moisture inside (in the gap) is removed, it is possible to improve the driving endurance of the electrostatic actuator.

Moreover, the bottom of the concave portion 24 is penetrated to form the ink feed opening 33 by a micro-blast processing or the like. The ink protection film (unshown in the drawing) made of the TEOS-$SiO_2$ is formed on the surface of the silicon substrate by the plasma CVD method in order to prevent the corrosion of the ink flow passage groove. Furthermore, the common electrode 26 made of metal is formed on the silicon substrate.

Figure 38G:
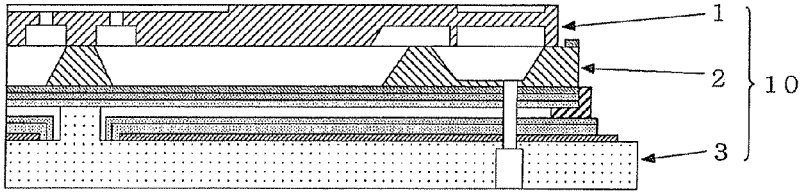

The cavity substrate 2 is fabricated from the silicon substrate 200 which is jointed to the electrode substrate 3 through the above-described process The nozzle substrate 1 in which the nozzle openings 11 and the like have been formed is adhered onto the surface of the cavity substrate 2 with adhesive (Step 14 is FIG. 36, FIG. 38G). The substrate is broke down into each head chip by dicing in the end and the main body of the above-described ink-jet head 10 is completed (Step 15 is FIG. 36).

According to the above-described method for manufacturing the ink-jet head 10, the pressure generated in the actuator can be improved. In addition, it is possible to manufacture the ink-jet head having the electrostatic actuator which excels in the dielectric strength voltage, the driving endurance and the discharge characteristic at low cost.

Moreover the cavity substrate 2 is formed from the silicon substrate 200 which is jointed to the prepared electrode substrate 3 according to the above-described method. This means that the cavity substrate 2 is supported by the electrode substrate 3 and the cavity substrate 2 will not be broken or get chipped even when it is made thin. Thereby it becomes easier to handle the cavity substrate 2. Consequently the yield rate is improved compared to that of the case where the cavity substrate 2 is separately fabricated.

Figure 39:
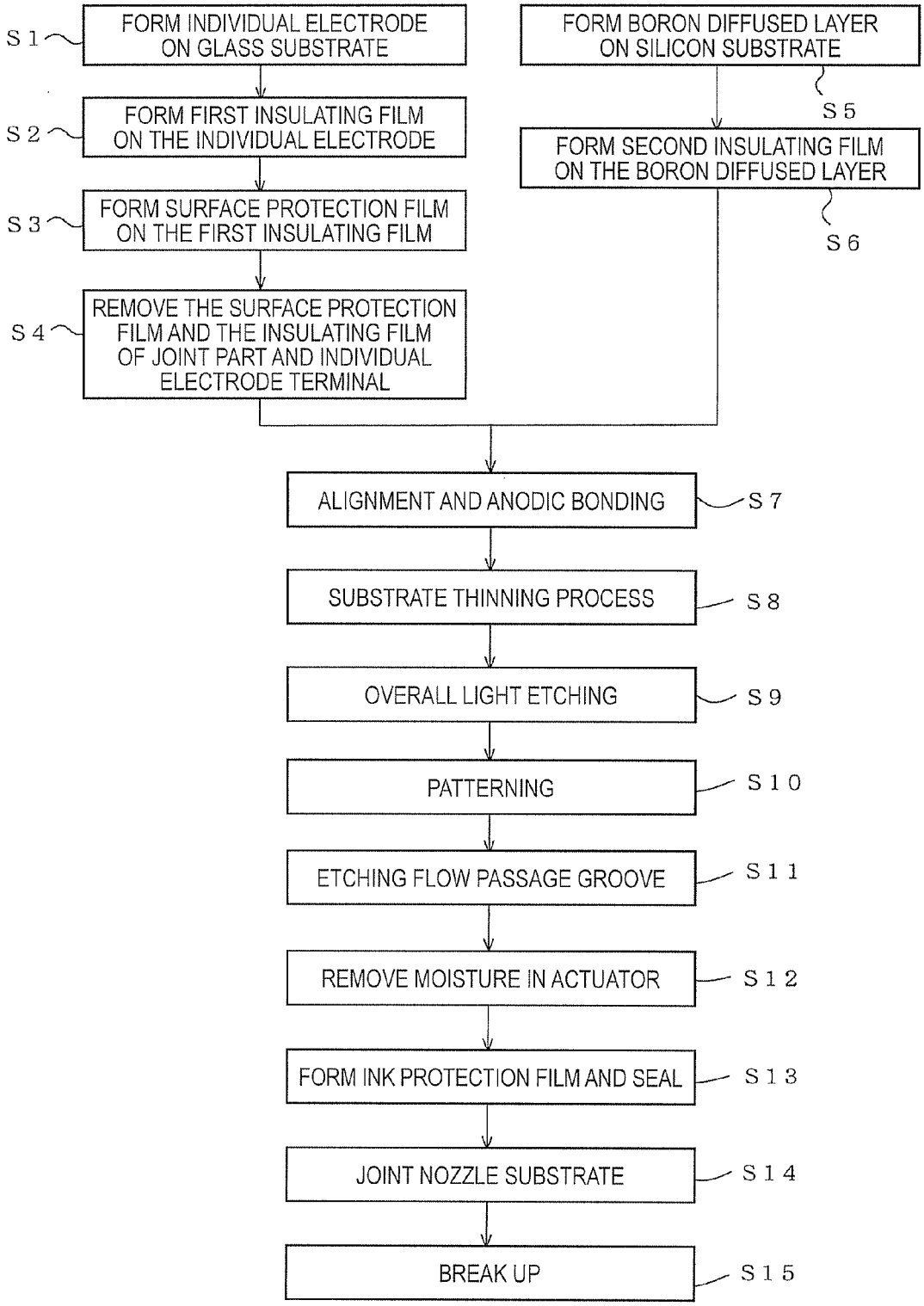
FIG. 39 is a flow chart schematically showing steps in the manufacturing process of the ink-jet head.
Figure 40A:
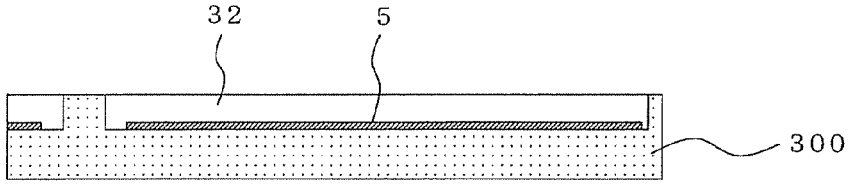
FIGS. 40A-40C are sectional views of the electrode substrate for showing steps in the manufacturing process schematically.
Figure 40B:
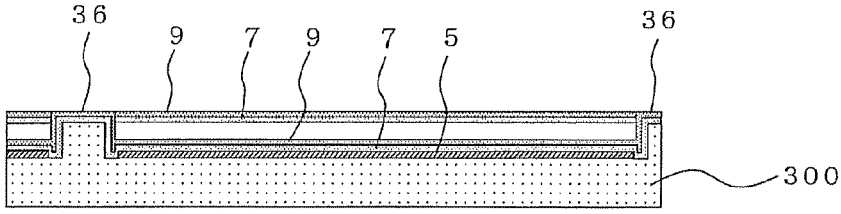
Figure 40C:
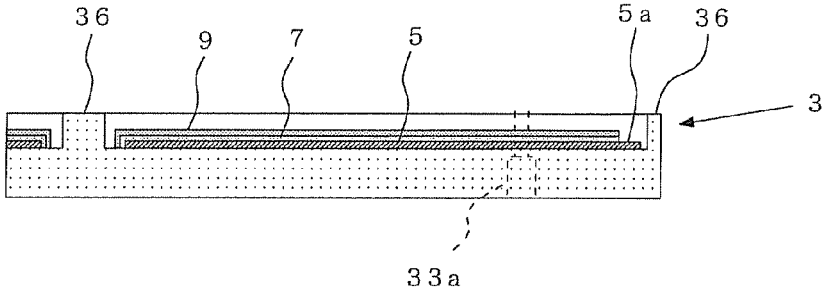

An example of manufacturing method of the ink-jet head 10 according to the seventh-eleventh embodiments is now described with reference to FIGS. 39-41. FIG. 39 is a flow chart schematically showing steps in the manufacturing process of the ink-jet head 10A. FIG. 40 is a sectional view of the electrode substrate 3 for showing steps in the manufacturing process schematically. FIG. 41 is a sectional view of the ink-jet head 10A for showing steps in the manufacturing process schematically.

Referring to FIG. 39, the steps S1-S4 are the steps for fabricating the electrode substrate 3, and the steps S5 and S6 are the steps for fabricating the silicon substrate from which the cavity substrate 2 is formed.

Here a method for manufacturing the ink-jet head 10A according to the seventh embodiment is mainly described and a method for other ink-jet head according to the eighth-eleventh embodiments will be described where necessary.

The electrode substrate 3 is fabricated as follows. The glass substrate 300 that is made of borosilicate or the like and has a thickness of about 1 mm is etched with hydrofluoric acid through for example an etching mask made of gold-chromium or the liked so as to form the concave portion 32 with a predetermined depth. The concave portion 32 is the groove whose size is larger than the shape of the individual electrode 5 and provided with respect to the individual electrode 5.

The indium tin oxide (ITO) film is subsequently formed in 100 nm thick by for example sputtering and the ITO film is then patterned by photolithography. The part of the ITO film other than the part where is going to be the individual electrode 5 is removed by etching. In this way, the individual electrode 5 is formed in the concave portion 32 (Step 1 in FIG. 39 and FIG. 40A).

An silicon oxide film (TEOS-$SiO_2$) having a thickness of 70 nm is formed as the first insulating film 7 of the individual electrode 5 side on the whole joint face of the glass substrate 300 by the RF-CVD method using tetra-ethoxy-silane (TEOS) as a material gas (Step 2 in FIG. 39). A DLC film having a predetermined thickness is then formed as the surface protection film 9 on the overall surface of the silicon oxide film by a parallel-plate type RF-CVD method using a toluene gas as a material gas (Step 3 is FIG. 39, FIG. 40B).

The DLC film existing in the position corresponding to the joint part 36 of the glass substrate 300 and the terminal part 5*a* of the individual electrode 5 is removed by patterning and $O_2$ ashing. After the DLC film is removed, the silicon oxide film existing in the same position is removed by dry-etching such as the reactive ion etching (RIE) using $CHF_3$ (Step 4 is FIG. 39, FIG. 40C). Subsequently the opening 33*a* which is going to be the ink feed opening 33 is formed by the blast processing or the like.

Through the above-described process, the electrode substrate 3 according to the seventh embodiment can be fabricated.

The electrode substrate 3 according to the second embodiment can be fabricated in the same way as the above-described first embodiment case.

In the case of the eighth and tenth embodiments, the hafnium oxide film 7*c* is formed to have a predetermined thickness as the first insulating film 7 of the individual electrode 5 side on the whole joint face of the glass substrate 300 by the electron cyclotron resonance (ECR) sputtering method. The alumina film 7*b* having a predetermined thickness is further formed on the hafnium oxide film. The DLC film having a predetermined thickness is then formed as the surface protection film 9 on the overall surface of the alumina film 7*b* by the parallel-plate type RF-CVD method using the toluene gas as a material gas. The DLC film existing in the position corresponding to the joint part 36 of the glass substrate 300 and the terminal part 5*a* of the individual electrode 5 is removed by patterning and $O_2$ ashing. After the DLC film is removed, the alumina film 7*b* and the hafnium oxide film 7*c* existing in the position are simultaneously removed by the RIE dry-etching using $CHF_3$.

In the case of the ninth embodiment, only the silicon oxide film (TEOS-$SiO_2$) is formed on the individual electrode 5 in the same manner as the seventh embodiment.

In the case of the eleventh embodiment, the alumina film 7*b* is formed to have a predetermined thickness as the first insulating film 7 of the individual electrode 5 side on the whole joint face of the glass substrate 300 by the ECR sputtering method. The DLC film having a predetermined thickness is then formed as the surface protection film 9 on the overall surface of the alumina film 7*b* by the parallel-plate type RF-CVD method using the toluene gas as a material gas. The DLC film existing in the position corresponding to the joint part 36 of the glass substrate 300 and the terminal part 5*a* of the individual electrode 5 is removed by patterning and $O_2$ ashing. After the DLC film is removed, the alumina film 7*b* existing in the position are simultaneously removed by the RIE dry-etching using $CHF_3$.

Through the above-described process, the electrode substrate 3 according to the seventh-eleventh embodiments can be fabricated.

After the silicon substrate 200 is anodically bonded to the electrode substrate 3 which is fabricated through the above-described process, the cavity substrate 2 is fabricated.

The silicon substrate 200 is fabricated by forming the boron diffused layer 201 whose thickness is for example 0.8 μm on one side of the silicon substrate 200 whose thickness is for example 280 μm (Step 5 is FIG. 39). The hafnium oxide film 8*c* having a thickness of 20 nm is formed as the second insulating film 8 on the whole surface (lower face) of the boron diffused layer 201 of the silicon substrate 200 by the ECR sputtering method. Subsequently the alumina film 8*b* having a thickness of 40 nm is formed as the second insulating film 8 on the whole surface of the hafnium oxide film 8*c* by the ECR sputtering method (Step 6 is FIG. 39, FIG. 41A).

In the case of the eleventh embodiment, only the thermally oxidized silicon film 8*a* having a predetermined thickness is formed on the whole face of the silicon substrate 200 by the thermal oxidation method.

In the case of the ninth embodiment, the hafnium oxide film 8*c* and the alumina film 8*b* which is formed on top of the hafnium oxide film 8*c* are formed in the same manner as the seventh embodiment, and the DLC film is then formed as the surface protection film 9 on the overall surface of the alumina film 8*b*. The patterning is performed in the slightly wider area of the DLC film including the part existing in the position corresponding to the joint part 36 of the glass substrate 300. The DLC film of the patterned area is removed by the $O_2$ ashing and the alumina film 8*b* which is the base insulating film is exposed.

In the case of the tenth embodiment, the thermally oxidized silicon film 8*a* is blanket-formed in the same manner as the eighth embodiment, and the DLC film is then formed as the surface protection film 9 on the thermally oxidized silicon film 8*a* on the boron diffused layer 201. The patterning is performed in the slightly wider area of the DLC film including the part existing in the position corresponding to the joint part 36 of the glass substrate 300. The DLC film of the patterned area is removed by the $O_2$ ashing and the thermally oxidized silicon film 8*a* which is the base insulating film is exposed.

In the case of the eleventh embodiment, the alumina film 8*b* having a predetermined thickness is formed as the second insulating film 8 on the whole surface of the boron diffused layer 201 by the ECR sputtering method. Subsequently the hafnium oxide film 8*c* having a predetermined thickness is formed on the whole surface of the alumina film 8*b* by the ECR sputtering method. The patterning is performed in the slightly wider area of the hafnium oxide film 8*c* including the part existing in the position corresponding to the joint part 36 of the glass substrate 300. The hafnium oxide film 8*c* of the patterned area is removed by the RIE dry-etching using $CHF_3$ and the alumina film 8*b* which is the base insulating film is exposed.

Through the above-described process, the silicon substrate 200 according to the seventh-eleventh embodiments can be fabricated.

Figure 41A:
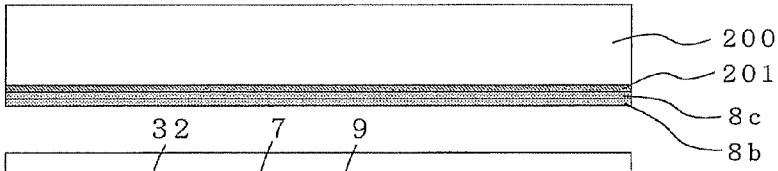
FIGS. 41A-41G are sectional views of the ink-jet head for showing steps in the manufacturing process schematically.
Figure 41B:
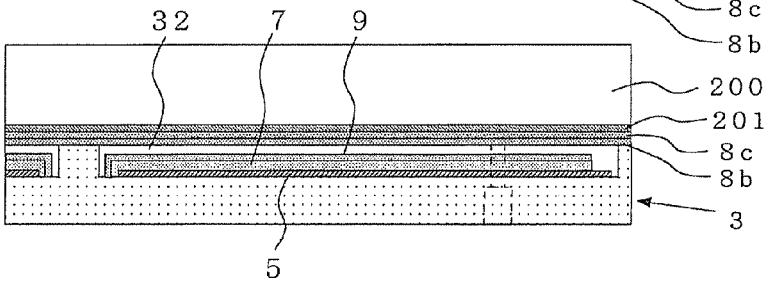

The silicon substrate 200 fabricated in the above-described process is aligned and anodically bonded onto the electrode substrate 3 (Step 7 is FIG. 39, FIG. 41B).

Figure 41C:
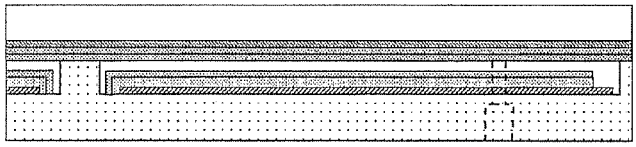

The whole surface of the bonded silicon substrate 200 is then polished for thinning the substrate so as to have a thickness of for example 50 μm (Step 8 is FIG. 39, FIG. 41C). The whole surface of the silicon substrate 200 is further light-etched by wet-etching so as to remove processing marks (Step 9 is FIG. 39).

Figure 41D:
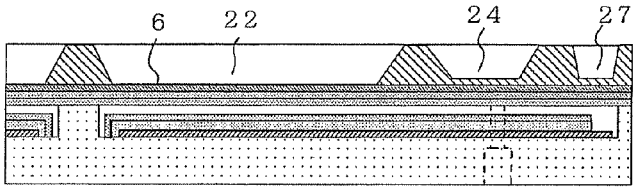
Figure 41E:
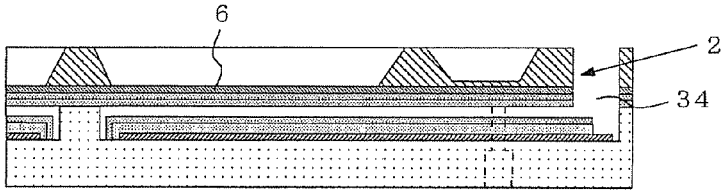
Figure 41F:
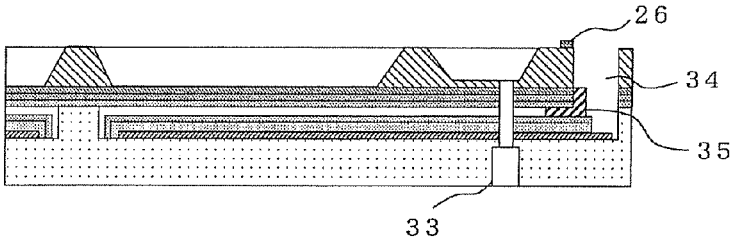

Resist patterning is performed on the surface of the jointed and thinned silicon substrate 200 by photolithography (Step 10 is FIG. 39) and the ink flow passage groove is formed by wet-etching or dry-etching (Step 11 is FIG. 39). Through this step, the concave portion 22 which is going to be the discharge chamber 21, the concave portion 24 which is going to be the reservoir 23 and the concave portion 27 which is going to be the electrode exposed part 34 (FIG. 41D). At this point, the etching will be stopped at the surface of the boron diffused layer 201 therefore the vibration plate 6 can be formed with a precise thickness and it is possible to avoid causing the roughness in the surface.

The bottom part of the concave portion 27 is removed by inductively coupled plasma (ICP) dry-etching so as to open the electrode exposed part 34 (FIG. 41E), the moisture staying in the electrostatic actuator is then removed (Step 12 is FIG. 39). The removal can be performed for example by putting the silicon substrate into a vacuum chamber and heat-vacuuming is performed. After a predetermined time passed, a nitrogen gas is introduced into the chamber, the sealant material 35 such as an epoxy resin or the like is applied to the gap opening end part under the nitrogen atmosphere and the actuator is air-tightly sealed (Step 13 is FIG. 39, FIG. 41F). Since the electrostatic actuator is air-tightly sealed after the moisture inside (in the gap) is removed, it is possible to improve the driving endurance of the electrostatic actuator.

Moreover, the bottom of the concave portion 24 is penetrated to form the ink feed opening 33 by the micro-blast processing or the like. The ink protection film (unshown in the drawing) made of the TEOS-$SiO_2$ is formed on the surface of the silicon substrate by the plasma CVD method in order to prevent the corrosion of the ink flow passage groove. Furthermore, the common electrode 26 made of metal is formed on the silicon substrate.

Figure 41G:
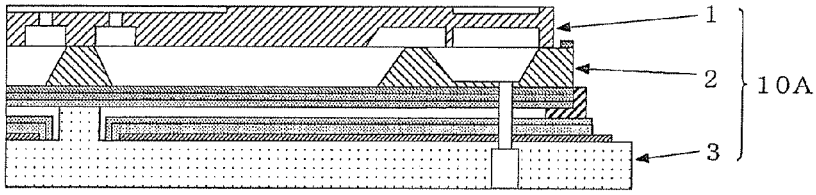

The cavity substrate 2 is fabricated from the silicon substrate 200 which is jointed to the electrode substrate 3 through the above-described process The nozzle substrate 1 in which the nozzle openings 11 and the like have been formed is adhered onto the surface of the cavity substrate 2 with adhesive (Step 14 is FIG. 39, FIG. 41G). The substrate is broke down into each head chip by dicing in the end and the main body of the above-described ink-jet head 10A is completed (Step 15 is FIG. 39).

The embodiments of the electrostatic actuator, the ink-jet head and the manufacturing methods thereof have been described. However the invention is obviously not limited to the specific embodiments described herein, but also encompasses any variations that may be considered by any person skilled in the art, within the general scope of the invention. For example the electrostatic actuator according to the invention can be used as a driving part of an optical switch, a mirror device; a micro-pump, a leaser operated mirror in a leaser printer or the like. Moreover, in addition to the ink-jet printer, the droplet discharge apparatus according to the invention can be used in the various applications such as for manufacturing a color filter of a liquid crystal display, for forming a light emitting part of an organic electroluminescence (EL) display device, and for fabricating a micro-array of biomolecule solution which is used genetic testing and the like.

Figure 42:
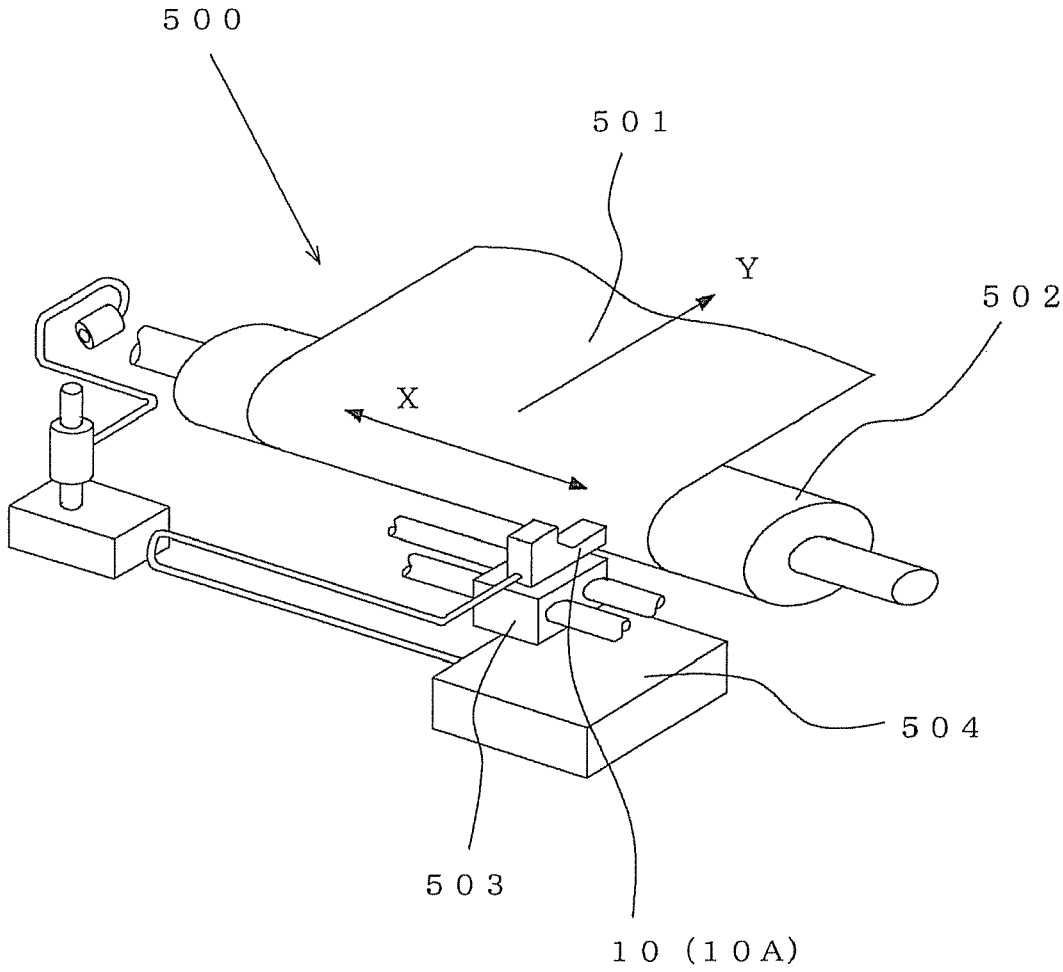
FIG. 42 is a schematic perspective view of an example of an ink-jet printer having the ink-jet head according to the invention.

FIG. 42 shows a schematic structure of an example of an ink-jet printer having the ink-jet head according to the invention.

Referring to FIG. 42, an ink-jet printer 500 includes a platen 502 that delivers a recording paper 501 in a sub-scan direction Y, the ink-jet head 10 (or 10A) whose ink-nozzle face opposes the platen 502, a carriage 503 that moves the ink-jet head 10 (or 10A) in a main-scan direction X, and an ink tank 504 from which ink is supplied to each ink nozzle in the ink-jet head 10. It is possible to realize a high-resolution and high-speed driving ink-jet printer with the ink-jet head 10 according to the invention.

What is claimed is:

1. An electrostatic actuator, comprising:

a fixed electrode formed on a substrate;

a movable electrode provided so as to oppose the fixed electrode with a predetermined gap therebetween;

a driving unit generating electrostatic force between the fixed electrode and the movable electrode and moving the movable electrode;

insulating films provided on opposing faces of the fixed electrode and the movable electrode, at least one of the insulating films having a layered structure of silicon oxide and a dielectric material whose relative permittivity is higher than the relative permittivity of the silicon oxide; and a surface protection film that is provided one or both of the insulating films and made of a ceramics-based hard film or a carbon-based hard film.

2. The electrostatic actuator according to claim 1, the surface protection film is made of a carbon-based material such as diamond and diamond-like carbon.

3. The electrostatic actuator according to claim 1, wherein the dielectric material whose relative permittivity is higher than the relative permittivity of the silicon oxide is selected at least one from the group including aluminum oxide ($Al_2O_3$), hafnium oxide ($HfO_2$), hafnium silicate nitride (HfSiN) and hafnium silicate oxynitride (HfSiON).

4. The electrostatic actuator according to claim 1, wherein the fixed electrode is formed on a glass substrate, the movable electrode is formed on a silicon substrate, and the glass substrate and the silicon substrate are jointed together through a silicon oxide film that is formed on at least one of joint faces of the substrates.

5. The electrostatic actuator according to claim 4, wherein the silicon oxide film of the insulating film that has the layered structure of the silicon oxide and the dielectric material whose relative permittivity is higher than the relative permittivity of the silicon oxide is provided on a joint face between the glass substrate and the silicon substrate.

6. The electrostatic actuator according to claim 1, further comprising a thermally oxidized silicon film provided on the movable electrode side as a second insulating film.

7. A droplet discharge head, comprising:

the electrostatic actuator according to claim 1;

a nozzle substrate having a single nozzle opening or a plurality of nozzle openings for discharging a droplet;

a cavity substrate in which a concave portion is formed, the concave portion serving as a discharge chamber that communicates with the nozzle opening; and a fixed electrode formed on the electrode substrate on which an individual electrode of the fixed electrode is formed, the individual electrode opposing a vibration plate of the movable electrode with the predetermined gap therebetween, and the movable electrode being formed at a bottom of the discharge chamber.

8. A droplet discharge apparatus comprising, the droplet discharge head according to claim 7.

9. An electrostatic actuator, comprising:

a fixed electrode formed on a substrate;

a movable electrode provided so as to oppose the fixed electrode with a predetermined gap therebetween;

a driving unit generating electrostatic force between the fixed electrode and the movable electrode and moving the movable electrode;

insulating films provided on opposing faces of the fixed electrode and the movable electrode, at least one of the insulating films having a layered structure of dielectric materials whose relative permittivity is higher than a relative permittivity of silicon oxide; and a surface protection film that is provided one or both of the insulating films and made of a ceramics-based hard film or a carbon-based hard film.

10. The electrostatic actuator according to claim 9, wherein the fixed electrode is formed on a glass substrate, the movable electrode is formed on a silicon substrate, and the glass substrate and the silicon substrate are jointed together through a silicon oxide film or an alumina film provided on a joint part.

* * * * *